US006898908B2

(12) United States Patent
Messenger et al.

(10) Patent No.: US 6,898,908 B2
(45) Date of Patent: May 31, 2005

(54) INSULATIVE CONCRETE BUILDING PANEL WITH CARBON FIBER AND STEEL REINFORCEMENT

(75) Inventors: Harold G. Messenger, Rehoboth, MA (US); Thomas G. Harmon, St. Louis, MO (US); Kenneth Baur, Mohnton, PA (US); Gary C. Graziano, Lititz, PA (US); Douglas L. Lorah, Narvon, PA (US)

(73) Assignee: Oldcastle Precast, Inc., Rehoboth, MA (US)

( * ) Notice: Subject to any disclaimer, the term of this patent is extended or adjusted under 35 U.S.C. 154(b) by 0 days.

(21) Appl. No.: 10/423,286

(22) Filed: Apr. 24, 2003

(65) Prior Publication Data

US 2004/0065034 A1 Apr. 8, 2004

Related U.S. Application Data

(63) Continuation-in-part of application No. 10/150,465, filed on May 17, 2002, now Pat. No. 6,729,090, which is a continuation-in-part of application No. 10/093,292, filed on Mar. 6, 2002, now Pat. No. 6,701,683.

(51) Int. Cl.[7] ..... E04C 2/288

(52) U.S. Cl. ..... 52/268; 52/309.11; 52/309.7; 52/406.1; 52/309.17

(58) Field of Search ..... 52/309.11, 268, 52/309.7, 309.14, 309.12, 309.17, 406.1

(56) References Cited

U.S. PATENT DOCUMENTS

| | | | | |
|---|---|---|---|---|
| 890,011 | A | | 6/1908 | Anderson |
| 1,229,904 | A | | 6/1917 | Day |
| 1,420,246 | A | | 6/1922 | Faber |
| 1,484,206 | A | | 2/1924 | Birkholz |
| 1,834,892 | A | | 12/1931 | Betzler |
| 1,891,837 | A | | 12/1932 | Pittman |
| 1,897,327 | A | | 2/1933 | Olson |
| 2,080,618 | A | | 5/1937 | Madsen |
| 2,312,293 | A | | 2/1943 | Weiss |
| 3,298,152 | A | | 1/1967 | Lockshaw |
| 3,305,991 | A | | 2/1967 | Weismann |
| 3,567,816 | A | | 3/1971 | Embree |
| 3,597,890 | A | | 8/1971 | Hala |
| 3,646,715 | A | | 3/1972 | Pope |
| 3,775,916 | A | | 12/1973 | Bair |
| 3,879,908 | A | | 4/1975 | Weismann |
| 4,019,297 | A | | 4/1977 | Murphy |
| 4,052,825 | A | | 10/1977 | Larsson |
| 4,073,998 | A | | 2/1978 | O'Connor |
| 4,104,842 | A | | 8/1978 | Rockstead et al. |
| 4,125,981 | A | | 11/1978 | MacLeod et al. |
| 4,229,497 | A | | 10/1980 | Piazza |
| 4,233,787 | A | | 11/1980 | Piazza |
| 4,505,019 | A | | 3/1985 | Deinzer |
| 4,567,705 | A | * | 2/1986 | Carlson ..... 52/405.3 |

(Continued)

FOREIGN PATENT DOCUMENTS

| | | |
|---|---|---|
| AU | 114294 | 12/1941 |
| EP | 16478 | 10/1980 |
| EP | 0 227 207 | 1/1987 |
| GB | 545526 | 6/1942 |
| GB | 2201175 | 8/1988 |

OTHER PUBLICATIONS

U.S. Appl. No. 10/093,292, filed Mar. 2002, Messenger.

*Primary Examiner*—Brian E. Glessner
*Assistant Examiner*—Basil Katcheves
(74) *Attorney, Agent, or Firm*—Sheridan Ross P.C.

(57) ABSTRACT

An insulative, lightweight concrete building panel is provided with one or more fiber or steel reinforcements which are manufactured in a controlled environment and can be easily transported and erected at a building site.

24 Claims, 20 Drawing Sheets

U.S. PATENT DOCUMENTS

| | | | | | |
|---|---|---|---|---|---|
| 4,611,450 | A | | 9/1986 | Chen | |
| 4,612,748 | A | | 9/1986 | Arnold et al. | |
| 4,617,219 | A | | 10/1986 | Shupack | |
| 4,706,430 | A | | 11/1987 | Sugita et al. | |
| 4,811,770 | A | | 3/1989 | Rapp | |
| 4,841,702 | A | | 6/1989 | Huettemann | |
| 4,912,902 | A | | 4/1990 | Weaver | |
| 4,916,004 | A | | 4/1990 | Ensminger et al. | |
| 4,934,121 | A | | 6/1990 | Zimmerman | |
| 4,990,390 | A | | 2/1991 | Kawasaki et al. | |
| 5,025,605 | A | | 6/1991 | Sekijima et al. | |
| 5,032,340 | A | | 7/1991 | Akihama et al. | |
| 5,058,345 | A | | 10/1991 | Martinez | |
| 5,095,674 | A | | 3/1992 | Huettemann | |
| 5,129,203 | A | | 7/1992 | Romero | |
| 5,146,721 | A | | 9/1992 | Candiracci | |
| 5,317,848 | A | | 6/1994 | Abbey | |
| 5,398,470 | A | | 3/1995 | Ritter et al. | |
| 5,493,836 | A | | 2/1996 | Lopez-Muñoz | |
| 5,493,838 | A | | 2/1996 | Ross | |
| 5,758,463 | A | | 6/1998 | Mancini, Jr. | |
| 5,836,715 | A | | 11/1998 | Hendrix et al. | |
| D406,902 | S | | 3/1999 | Lockwood | |
| 5,894,003 | A | | 4/1999 | Lockwood | |
| D426,321 | S | | 6/2000 | Lockwood | |
| 6,088,985 | A | | 7/2000 | Clark | |
| 6,094,881 | A | | 8/2000 | Lockwood | |
| 6,101,779 | A | * | 8/2000 | Davenport | 52/602 |
| 6,164,035 | A | | 12/2000 | Roberts | |
| 6,185,890 | B1 | * | 2/2001 | Ritter | 52/309.11 |
| 6,202,375 | B1 | * | 3/2001 | Kleinschmidt | 52/309.11 |
| 6,230,465 | B1 | | 5/2001 | Messenger et al. | |
| 6,237,297 | B1 | | 5/2001 | Paroly | |
| 6,263,629 | B1 | | 7/2001 | Brown | |
| 6,272,805 | B1 | | 8/2001 | Ritter et al. | |
| 6,345,483 | B1 | | 2/2002 | Clark | |
| 6,438,923 | B2 | * | 8/2002 | Miller | 52/745.19 |
| 6,622,444 | B2 | * | 9/2003 | Zarate Sanchez et al. | 52/309.11 |
| 6,701,683 | B2 | * | 3/2004 | Messenger et al. | 52/309.11 |
| 6,718,712 | B1 | * | 4/2004 | Heath | 52/309.12 |
| 6,729,090 | B2 | * | 5/2004 | Messenger et al. | 52/309.12 |
| 6,735,914 | B2 | * | 5/2004 | Konopka | 52/309.11 |
| 2001/0010140 | A1 | | 8/2001 | Ritter et al. | |
| 2002/0189182 | A1 | | 12/2002 | Record | |
| 2003/0029107 | A1 | | 2/2003 | Ritter et al. | |

* cited by examiner

INSULATIVE CONCRETE BUILDING PANEL WITH CARBON FIBER AND STEEL REINFORCEMENT

This application is a continuation-in-part and claims priority to U.S. patent application Ser. No. 10/150,465 filed May 17, 2002, now issued U.S. Pat. No. 6,729,090, which is a continuation-in-part of U.S. patent application Ser. No. 10/093,292, filed Mar. 6, 2002, now issued U.S. Pat. No. 6,701,683 both patents being incorporated herein in their entirety by reference.

FIELD OF THE INVENTION

The present invention relates to building components, and more specifically composite lightweight building panels which can be interconnected to build structures such as modular buildings or applied as cladding to building frames.

BACKGROUND OF THE INVENTION

Due to the high cost of traditional concrete components and the extensive transportation and labor costs associated therein, there is a significant need in the construction industry to provide a lightweight, precast, composite building panel which may be transported to a building site and assembled to provide a structure with superior strength and insulative properties. Previous attempts to provide these types of materials have failed due to the extensive transportation costs, low insulative values and thermal conductivity associated with prefabricated concrete wire reinforced products. Further, due to the brittle nature of concrete, many of these types of building panels become cracked and damaged during transportation.

More specifically, the relatively large weight per square foot of previous building panels has resulted in high expenses arising not only from the amount of materials needed for fabrication, but also the cost of transporting and erecting the modules. Module weight also placed effective limits on the height of structures, such as stacked modules, e.g. due to limitations on the total weight carried by the foundations, footings and lowermost modules. Furthermore, there is substantial fabrication labor expense that can arise from efforts needed to design reinforcement, and the materials and labor costs involved in providing and placing reinforcement materials. Accordingly, it would be useful to provide a system for modular construction which is relatively light, can be readily stacked to heights greater than in previous configurations and, preferably, inexpensive to design and manufacture.

Further, in many situations panels or modules are situated in locations where it is desirable to have openings therethrough to accommodate doorways, windows, cables, pipes and the like. In some previous approaches, panels were required to be specially designed and cast so as to include any necessary openings, requiring careful planning and design and increasing costs due to the special, non-standard configuration of such panels. In other approaches, panels were cast without such openings and the openings were formed after casting, e.g. by sawing or similar procedures. Such post-casting procedures as cutting, particularly through the thick and/or steel-reinforced panels as described above, is a relatively labor-intensive and expensive process. In many processes for creating openings, there was a relatively high potential for cracking or splitting of a panel or module. Accordingly, it would be useful to provide panels and modules which can be post-fitted with openings such as doors and windows in desired locations and with a reduced potential for cracking or splitting.

One further problem associated with metallic wire materials used in conjunction with concrete is the varying rates of expansion and contraction. Thus with extreme heating and cooling the metallic wire tends to separate from the concrete, thus creating cracks, exposure to moisture and the eventual degradation of both the concrete and wire reinforcement.

One example of a composite building panel which attempts to resolve these problems with modular panel construction is described in U.S. Pat. No. 6,202,375 to Kleinschmidt (the '375 patent). In this invention, a building system is provided which utilizes an insulative core with an interior and exterior sheet of concrete and which is held together with a metallic wire mesh positioned on both sides of an insulative core. The wire mesh is embedded in concrete, and held together by a plurality of metallic wires extending through said insulative core at a right angle to the longitudinal plane of the insulative core and concrete panels. Although providing an advantage over homogenous concrete panels, the composite panel disclosed in the '375 patent does not provide the necessary strength and flexure properties required during transportation and high wind applications. Further, the metallic wire mesh materials are susceptible to corrosion when exposed to water during fabrication, and have poor insulative qualities due to the high heat transfer qualities of metallic wire. Thus, the panels disclosed in the '375 patent may eventually fail when various stresses are applied to the building panel during transportation, assembly or subsequent use. Furthermore, these panels have poor insulative qualities in cold climates due to the high heat transfer associated with the metallic wires.

Other attempts have been made to use improved building materials that incorporate carbon fiber. One example is described in U.S. Pat. No. 6,230,465 to Messenger, et al. which utilizes carbon fiber in combination with a steel reinforced precast frame with concrete. Unfortunately, the insulative properties are relatively poor due to the physical nature of the concrete and steel, as well as the excessive weight and inherent problems associated with transportation, stacking, etc. Further, previously known prefabricated building panels have not been found to have sufficient tensile and compressive strength when utilizing only concrete and insulative foam materials or wire mesh. Thus, there is a significant need for a lightweight concrete building panel which has increased tensile and compressive strength, and which utilizes one or more commonly known building materials to achieve this purpose.

Accordingly, there is a significant need in the construction and building industry to provide a composite building panel which may be used in modular construction and which is lightweight, provides superior strength and has high insulative values. Further, a method of making these types of building panels is needed which is inexpensive, utilizes commonly known manufacturing equipment, and which can be used to mass produce building panels for use in the modular construction of warehouses, low cost permanent housing, hotels, and other buildings.

SUMMARY OF THE INVENTION

It is thus one aspect of the present invention to provide a composite wall panel which has superior strength, high insulating properties, is lightweight for transportation and stacking purposes and is cost effective to manufacture. Thus, in one embodiment of the present invention, a substantially planar insulative core with interior and exterior surfaces is positioned between concrete panels which are reinforced with carbon fiber grids positioned substantially adjacent the insulative core and which is interconnected to a plurality of diagonal carbon fiber strands. In a preferred embodiment of the present invention, the interior layer of concrete is comprised of a low-density concrete.

It is yet another aspect of the present invention to provide a superior strength composite wall panel which utilizes carbon fiber materials which are oriented in a novel geometric configuration which interconnects the insulative core and both the interior and exterior concrete panels. In one embodiment of the present invention, a plurality of carbon fibers are oriented in a substantially diagonal orientation through the insulative core and which may be operably interconnected to carbon fiber mesh grids positioned proximate to the interior and exterior surfaces of the insulative core and which operably interconnect both the interior and exterior concrete panels to the insulative core. Preferably, the carbon fiber mesh grid is comprised of a plurality of first carbon fiber strands extending in a first direction which are operably interconnected to a plurality of second carbon fiber strands oriented in a second direction. Preferably, the carbon fiber mesh grids are embedded within the interior and exterior concrete panels.

It is a further aspect of the present invention to provide a composite wall panel with an insulative core which has superior compressive strength than typical composite materials comprised of styrofoam and other similar materials. Thus, in another aspect of the present invention, a plurality of anti-compression pins are placed throughout the insulative core and which extend substantially between the interior and exterior surfaces of the insulative core. Preferably, these pins are comprised of ceramic, fiberglass, carbon-fiber or other materials which are resistant to compression and do not readily transfer heat.

It is another aspect of the present invention to provide a composite wall panel which can be easily modified to accept any number of exterior textures, surfaces or cladding materials for use in a plurality of applications. Thus, the present invention is capable of being finished with a brick surface, stucco, siding and any other type of exterior surface. In one embodiment of the present invention, a paraffin protective covering is provided on the exterior surface for protection of the exterior surface during manufacturing. The paraffin additionally prevents an excessive bond between the individual bricks and exterior concrete wall to allow the removal of a cracked or damaged brick and additionally has been found to reduce cracking in the bricks due to the differential shrinkage of the exterior concrete layer and clay brick. Furthermore, other types of materials such as drywall and other interior finishes can be applied to the interior concrete panel as necessary for any given application.

It is yet a further aspect of the present invention to provide a novel brick configuration which allows broken or cracked bricks to be quickly and effectively replaced. Thus, in one embodiment of the present invention a beveled brick design is provided wherein a rear portion of the brick has a greater diameter than a front end, and is embedded into the exterior concrete layer during the forming process. This design provides superior strength, and allows a damaged brick to be chiseled free and quickly replaced with a new brick by applying a glue or epoxy material.

It is yet another aspect of the present invention to provide a composite modular wall panel which can be used to quickly and efficiently construct modular buildings and temporary shelters and is designed to be completely functional with regard to electrical wiring and other utilities such as telephone lines, etc. Thus, the present invention in one embodiment includes at least one utility line which may be positioned at least partially within the composite wall panel and which accepts substantially any type of utility line which may be required in residential or commercial construction, and which can be quickly interconnected to exterior service lines. This utility line may be oriented in one or more directions and positioned either near the interior concrete panel, exterior concrete panel, or both.

It is yet another aspect of the present invention to provide a novel surface configuration of the insulative core which assures a preferred spacing between the surface of the insulative core and the carbon fiber grid. This surface configuration is applicable for a front surface, a rear surface, or both depending on the application. More specifically, the spacing is designed to provide a gap between the interior and/or the exterior surface of the insulative core and the carbon fiber grids to assure that concrete or other facing materials become positioned between the surface of the insulative core and the carbon fiber grid. This improved and consistent spacing enhances the strength and durability of the insulative panel when interconnected to the facing material, carbon fiber grids and transverse fibers and/or steel prestressing strands.

Thus, in one embodiment of the present invention the insulative core may have an interior and/or an exterior surface which is undulating, i.e., wavy alternative embodiments may have channels or protruding rails, spacer "buttons", a "waffleboard" configuration, or other shapes which create a preferred spacing between the surface of the insulative material and the fiber grids. Preferably, the spacing apparatus, channels, rails or other spacers are integrally molded with the insulative core to reduce labor and expenses. Alternatively, these spacing apparatus may be interconnected to the insulative foam after manufacturing, and may be attached with adhesives, screws, nails, staples or other interconnection means well known by one skilled in the art.

Thus, in one embodiment of the present invention, a reinforced insulative core which adapted for use with at least one facing material is provided, and which comprises:

- an insulative material having a front surface, a back surface, a top side, a bottom side and a pair of opposing lateral edges extending there between;
- a first plurality of fibers positioned proximate to said front surface and extending substantially between said top side, said bottom side and said pair of opposing lateral edges;
- a second plurality of fibers positioned proximate to said back surface and extending substantially between said top side, said bottom side and said pair of opposing lateral edges;
- at least one interwoven fiber grid extending from said back surface to said front surface of said substantially insulative planar material, and interconnecting said first plurality of fibers to said second plurality of fibers; wherein said substantially planar insulative material, said interwoven fiber grid and said first and said second plurality of fibers are operatively interconnected; and
- a plurality of protuberances extending outwardly from said front surface and said back surface of said insulative material, wherein a space is provided between said first and said second plurality of fibers, respectively, and said front surface and said back surface.

It is a further aspect of the present invention to provide a lightweight, durable building panel which utilizes concrete and expanded polystyrene materials, along with a unique geometry of carbon fiber, steel reinforcing rods, and wire mesh to create a building panel with superior strength and durability. The building may utilize one or more reinforcing materials such as carbon fiber, wire mesh or steel reinforcing bars positioned along 1) a perimeter edge; 2) an interior portion within the perimeter edge; or 3) both along the perimeter edges and within a predetermined interior portion of the building panel. Thus, in one embodiment of the present invention a lightweight, durable concrete building panel is provided, comprising:

a substantially planar concrete panel comprising an inner surface, an outer surface, an upper end and a lower end, and a substantially longitudinal axis defined between said upper end and said lower end;

a first carbon fiber grid positioned within said substantially planar concrete panel between said upper end and said lower end and positioned proximate to said inner surface;

a foam core having an inner surface and an outer surface positioned within said substantially planar concrete panel and extending substantially between said upper end and said lower ends of said substantially planar concrete panel;

at least one carbon fiber shear strip extending through said foam and oriented in a substantially linear direction between said upper end and said lower ends of said substantially planar concrete panel;

at least one first reinforcing bar positioned proximate to said at least one carbon fiber shear strip, and extending substantially between said upper end and said lower end of said substantially planar concrete panel; and a wire mesh material positioned above said upper surface of said foam core and proximate to said outer surface of said substantially planar concrete panel.

In a preferred embodiment of the present invention, the insulative core is comprised of a plurality of individual insulative panels. The seam of the insulative panels preferably has a cut-out portion which is used to support reinforcing materials such as rebar, carbon fiber or other material.

It is a further aspect of the present invention to provide a method of fabricating an insulative concrete building panel in a controlled manufacturing facility which is cost effective, utilizes commonly known building materials and produces a superior product. It is a further aspect of the present invention to provide a manufacturing process which can be custom tailored to produce a building panel with custom sizes, allows modifications for windows and doors, and which utilizes a variety of commonly known materials without significantly altering the fabrication protocol.

Thus, in one aspect of the present invention, a method for fabricating a lightweight, durable concrete building panel is provided, comprising the steps of:

a) providing a form having a first end, a second end, and lateral edges extending therebetween;
b) pouring a first layer of concrete material into a lower portion of said form;
c) positioning a first grid of carbon fiber material into said concrete material;
d) positioning a layer of foam core onto said first layer of concrete material, said layer of foam core having a plurality of reinforced sections extending substantially between said first end and said second end, said reinforced sections comprising:
   1) a second grid of carbon fiber extending substantially between said first end and said second end of said foam core;
   2) at least one metallic reinforcing bar positioned proximate to said second grid of carbon fiber and extending between said front end and said second end of said foam core;
e) pouring a second layer of concrete over said layer of foam core and said plurality of reinforced sections;
f) positioning at least one of a wire mesh material and a carbon fiber material into said second layer of concrete;
g) allowing said first layer and said second layer of concrete to cure; and
h) removing said concrete building panel from said form, wherein said lightweight concrete building panel is available for transportation and use.

DETAILED DESCRIPTION

Figure 1:
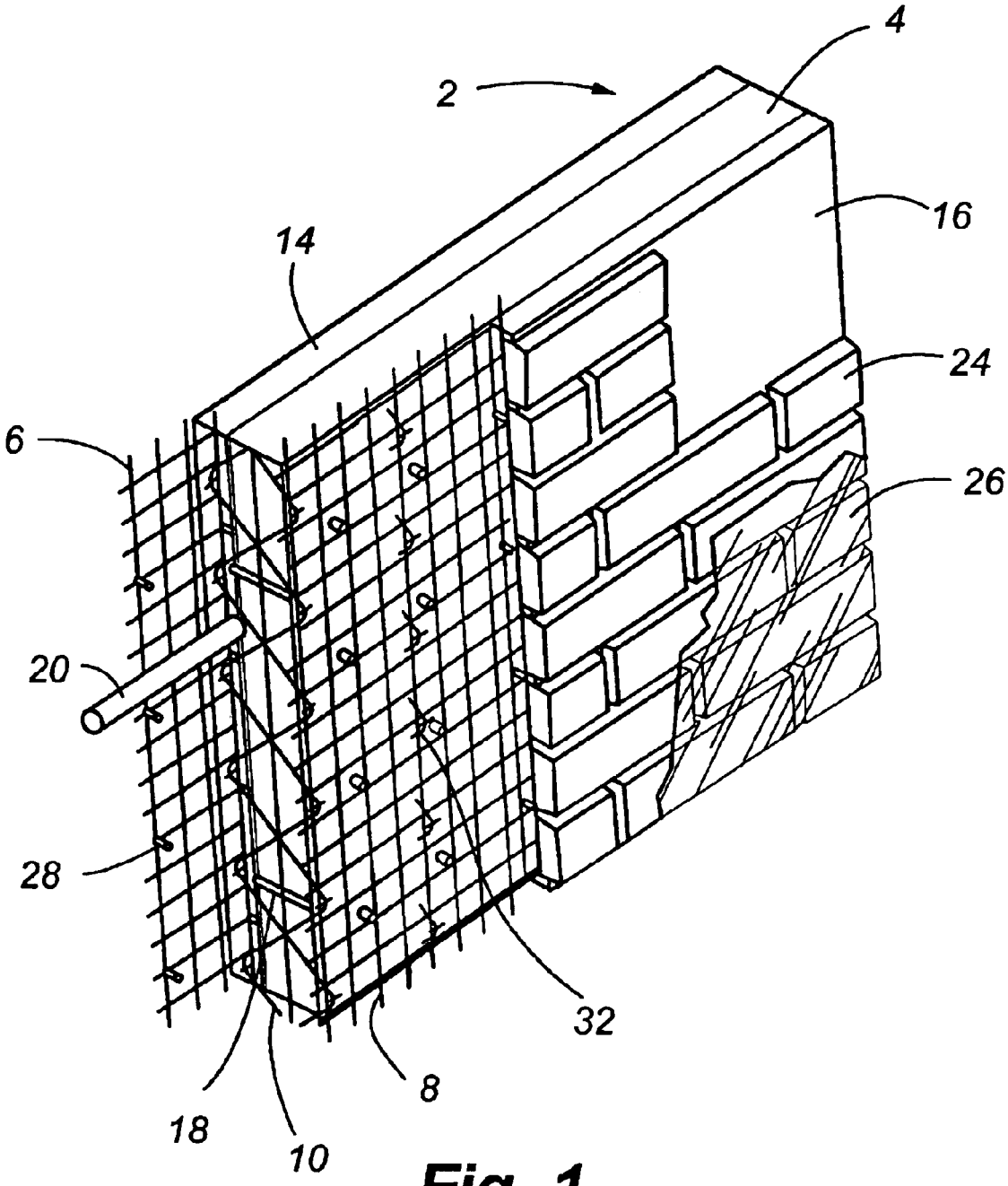
FIG. 1 is a front perspective view of a composite building panel which represents one embodiment of the present invention.

Referring now to the drawings, FIG. 1 is a front perspective view of one embodiment of the present invention and which generally identifies a novel composite building panel 2. The building panel 2 is generally comprised of an insulative core 4 which has an interior and exterior surface and a substantially longitudinal plane extending from a lower portion to an upper portion of said insulative core 4. The interior surface of the insulative core 4 is positioned immediately adjacent an interior concrete layer 14, while the exterior layer of the insulative core 4 is positioned substantially adjacent an exterior concrete layer 16. An interior carbon fiber grid 6 and an exterior carbon fiber grid 8 are additionally positioned substantially adjacent the interior and exterior surfaces of the insulative core 4, respectively, and which are preferably embedded within the interior concrete layer 14 and the exterior concrete layer 16. These carbon fiber grids are connected to a plurality of carbon fiber strands 10 which are oriented in a substantially diagonal configuration with respect to the longitudinal plane of the insulative core 4. The plurality of carbon fiber strands extend from the exterior concrete carbon fiber grid 8 through the insulative core 4 and are interconnected to the interior carbon fiber grid 6 on the opposing side. To assure proper spacing of the interior carbon fiber grid 6 and exterior carbon fiber grid 8, a plurality of spacers 28 may be employed in one embodiment of the present invention. Additionally, plastic or metallic connector clips 32 are preferably used to interconnect the carbon fiber strands 10 to the interior carbon fiber grid 6 and exterior carbon fiber grid 8.

As further identified in FIG. 1, in one embodiment of the present invention a utility conduit 20 is provided which is at least partially embedded in the insulative core 4 while partially embedded in the interior concrete layer 14 and which is used to contain electrical wiring, cabling, telephone wiring, and other types of utility lines commonly used in the construction of interior walls and building panels. The conduit is preferably comprised of a PVC plastic based on the cost, flexibility and low heat transfer properties, but as appreciated by one skilled in the art may also be a clad metal, fiberglass, or other materials. Furthermore, the utility conduit 20 may be positioned in the center of the insulative core 4, within the exterior concrete layer 16 or interior concrete layer 14, or may be oriented in a vertical as well as horizontal direction.

As additionally seen in FIG. 1, an exterior cladding material 22 is provided which in this particular example comprises a plurality of bricks 24. Alternatively, stucco, vinyl or wood siding may additionally be used as well as other materials commonly known in the construction industry. Additionally, when a plurality of bricks 24 are employed, a paraffin protective coating material 26 may be applied on the exterior surface of the bricks 24 prior to placement and casting. Upon completion of casting of the modular panel, the paraffin coating 26 or other protective coating may be removed by hot steam to provide a clean surface.

In another embodiment of the present invention, a plurality of compression pins 18 may be positioned throughout the insulative core 4 to provide additional compressive strength to the composite panel 2. Thus, as identified in FIGS. 1 and 2, the compression pins 18 are generally positioned at right angles to the longitudinal plane of the substantially planar insulative core 4, and may be comprised of ceramic, fiberglass, carbon fiber or other materials which are resistant to compression and have low heat transfer properties and are not susceptible to corrosion and rust when exposed to water. In one embodiment, the compression pins are comprised of a plastic PVC material having a length based on the thickness of the insulative core 4, and which is generally between about 1.5 inches and 3 inches and a diameter of between about 0.25 inches to 1 inch.

Figure 2:
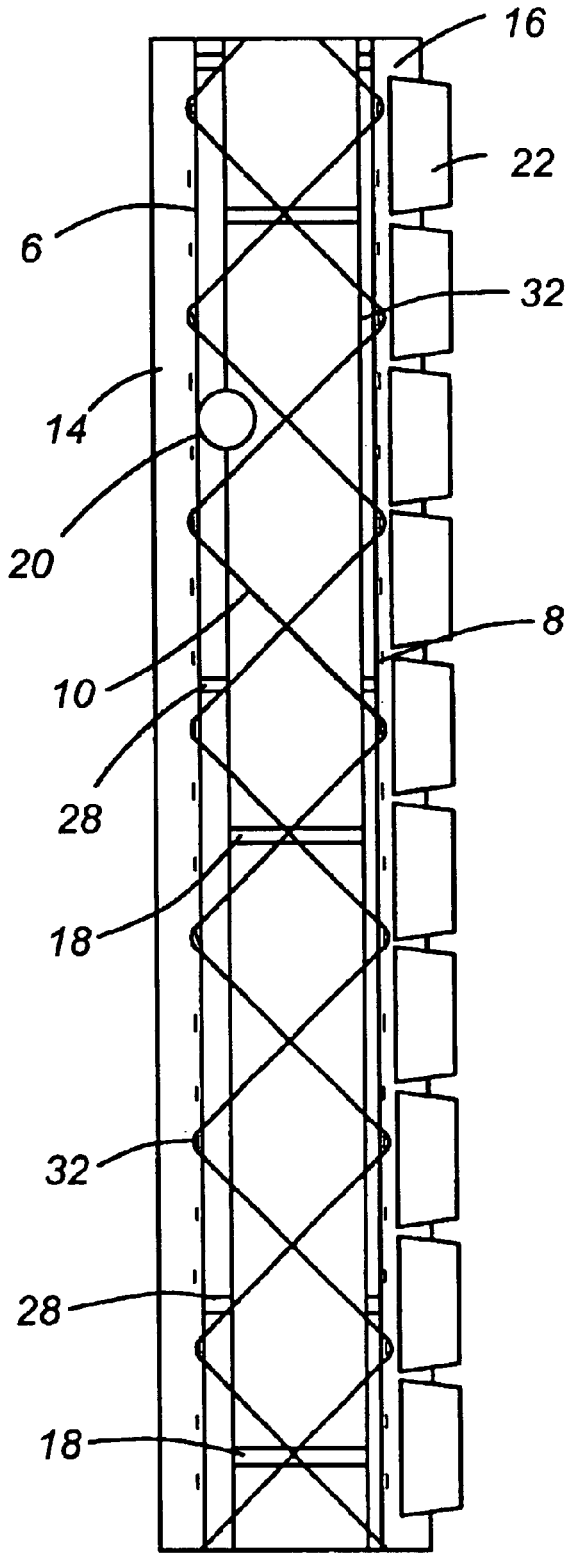
FIG. 2 is a left elevation view of the embodiment shown in FIG. 1.

Referring now to FIG. 2, a left elevation end view is provided of the panel shown in FIG. 1, and which provides additional detail regarding the various components utilized in the composite wall panel 2. As depicted, the central portion of the composite wall panel 2 comprises an insulative core 4. This insulative core is generally comprised of styrofoam or other similar lightweight material and has a width of between about 1 to 4 inches, and more preferably about 2.5 inches. As appreciated by one skilled in the art, the thickness of the insulative core 4 is dependent upon the specifications of the building structure and the application for use, including average local outside air temperature, building height, anticipated wind forces, etc.

In one embodiment of the present invention, the insulative core 4 is manufactured in a unique process with a plurality of carbon fibers strands 10 positioned in a ribbon/tape pattern 30 which extends through the insulative core 4 and which protrudes beyond both the interior and exterior surfaces to accommodate interconnection to the interior and exterior carbon fiber grids. Alternatively, metallic materials such as wire and mesh comprised of steel or other similar materials may also be used as appreciated by one skilled in the art.

Figure 4:
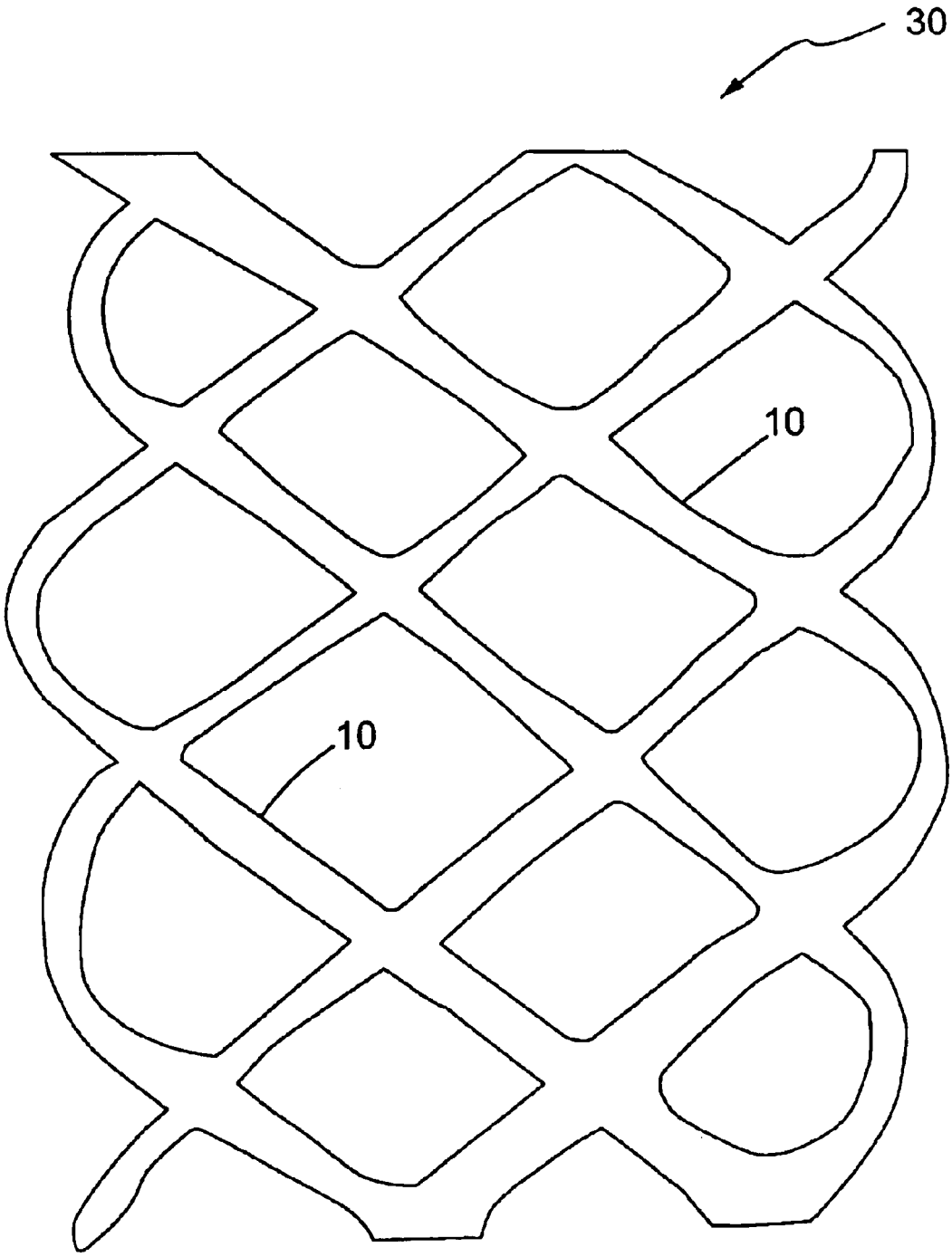
FIG. 4 is a top plan view of one embodiment of a carbon fiber tape which is positioned within an insulative core of the composite building panel of the present invention.

A depiction of one embodiment of the carbon fiber strands 10 and their orientation and interconnection may be seen in FIG. 4. These carbon fiber strands 10 generally have a thickness of between about 0.05 inches to 0.4 inch, and more preferably a diameter of about 0.15 inches. As more typically referred to in the art, the carbon fiber strands 10 have a given "tow" size. The tow is the number of carbon strands, and may be in the example between about 12,000–48,000 individual strands, i.e., 12 K to 48 K tow. The intersection points of the carbon fiber strands which are required to make the tape pattern are interconnected with a strong resin such as a thermoset which si applied under a predetermined heat and pressure. In another embodiment, the individual strands of carbon fiber may be "woven" with other strands to create a stronger ribbon/tape material 30.

As shown in FIG. 2, the carbon fiber strands 10 are interconnected to the interior carbon fiber grid 6 positioned substantially adjacent to the interior surface of the insulative core and with the exterior carbon fiber grid 8 positioned substantially adjacent the exterior surface of the insulative core 4. One example of a carbon fiber grid ribbon 30 which may be used in the present invention is the "MeC-GRID™" carbon fiber material which is manufactured by Hexcel Clark-Schwebel. The interior and exterior carbon grid tape is comprised generally of looped or crossed weft and warped strands, that run substantially perpendicular to each other and are machine placed on several main tape "stabilizing strands" that run parallel to the running/rolling direction of the tape. The carbon fiber tape is then used in a totally separate process by casting it transversely through the insulating core 4, to produce an insulated structural core panel that links together compositively the interior concrete layer 14 and exterior concrete layer 16 of the composite wall panel 2.

After manufacturing, the insulative core 4 can be interconnected to the interior carbon fiber grid 6 and exterior carbon fiber grid 8 and the utility conduit 20 is placed in position along with any of the compression pins 18, and other spacers 28, to assure the proper positioning of the wall panel components prior to pouring the interior concrete layer 14 or exterior concrete layer 16. The insulative core 4 is then positioned in a form, wherein the interior concrete layer 14 is poured as well as the exterior concrete layer 16 as necessary. Once the interior and exterior concrete layers are cured and set, the composite wall panel 2 is removed from the form and is subsequently ready for transportation. Alternatively exterior cladding materials 22 such as bricks or form liners may be positioned prior to pouring the exterior concrete layer 16 to allow the bricks 24 to be integrally interconnected to the concrete.

Figure 3:
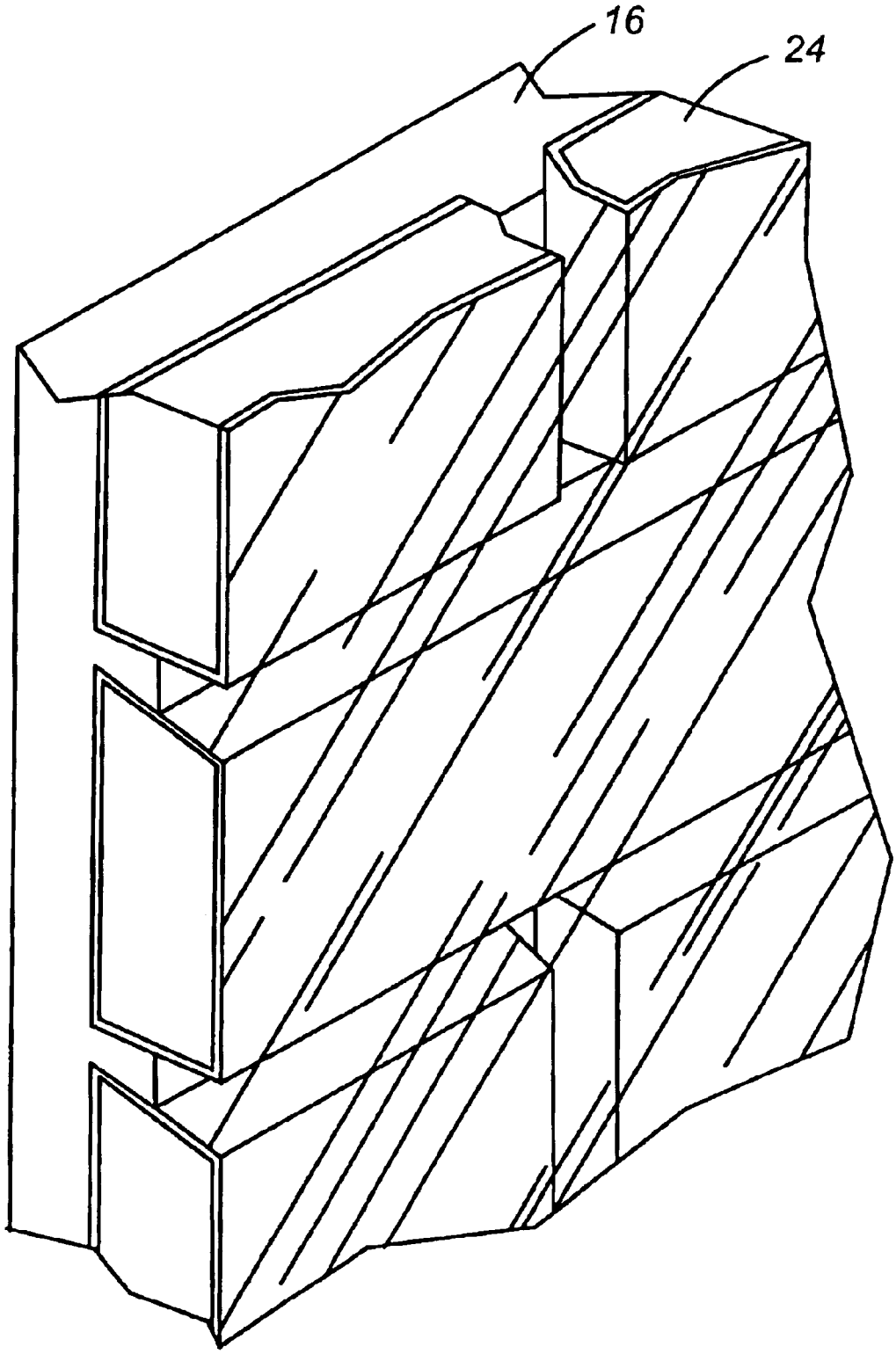
FIG. 3 is a front perspective view identifying an outer concrete layer and a novel brick cladding material embedded therein.

Referring now to FIG. 3, a front perspective view of one embodiment of the present invention is shown herein, wherein an exterior cladding material 22 of brick 24 is shown embedded in the exterior concrete layer 16. In this particular embodiment the plurality of bricks 24 are embedded into the exterior concrete layer 16 to provide a finished look and which may include a variety of other materials such as stucco, vinyl siding, and others as previously discussed. In a preferred embodiment, the outermost optional cladding layer is placed on the casting form face down during the manufacturing process and which may additionally be made of tile, brick slips, exposed aggregate or a multitude of other exterior finish components as is required. The exterior cladding 22 typically adds ¼ to ⅝ inch to the overall wall thickness and must be able to withstand moisture and water penetration, ultraviolet and sunlight exposure, and a full range of potentially extreme surface temperature changes as well as physical abuse, all without the danger of deterioration or delamination of the exterior cladding material 22 from the exterior concrete layer 16.

In a preferred embodiment of the present invention, the bricks 24 are provided with a rear end having a greater diameter than a forward end, and thus creating a trapezoidal type profile as shown in FIGS. 2 and 3. By utilizing this shape of brick 24, the bricks are integrally secured to the exterior concrete layer 16. Further, if one or more bricks become damaged or chipped during manufacturing or transportation, they may be chiseled out and a replacement brick glued in its place with an epoxy or other type of glue commonly known in the art.

With regard to the concrete utilized in various embodiments of the present application, the interior wall may be comprised of a low density concrete such as Cret-o-Lite™, which is manufactured by Advanced Materials Company of Hamburg, N.Y. This is an air dried cellular concrete which is nailable, drillable, screwable, sawable and very fire resistant. In a preferred embodiment, the exterior concrete layer 16 is comprised of a dense concrete material to resist moisture penetration and in one embodiment is created using VISCO CRETE™ or equal product which is a chemical that enables the high slumped short pot life liquification of concrete to enable the concrete to be placed in narrow wall cavities with minimum vibration and thus create a high density substantially impermeable concrete layer. VISCO-CRETE™ is manufactured by the Sika Corporation, located in Lyndhurst, N.J. The exterior concrete layer 16 is preferably about ¾ to 2 inches thick, and more preferably about 1.25 inches thick. This concrete layer has a compression strength of approximately 5000 psi after 28 days of curing, and is thus extremely weather resistant.

In a preferred embodiment of the present invention, a vapor barrier material 12 may be positioned next to or on to the exterior surface of the insulative core 4, or alternatively on the interior surface of the insulative foam core 4. The vapor barrier 12 impedes the penetration of moisture and thus protects the foam core from harsh environmental conditions caused by temperature changes. Preferably, the vapor barrier 12 is comprised of a plastic sheet material, or other substantially impermeable materials that may be applied to the insulative core 4 during manufacturing of the foam core, or alternatively applied after manufacturing and prior to the pouring of the exterior concrete layer 16.

Figure 5:
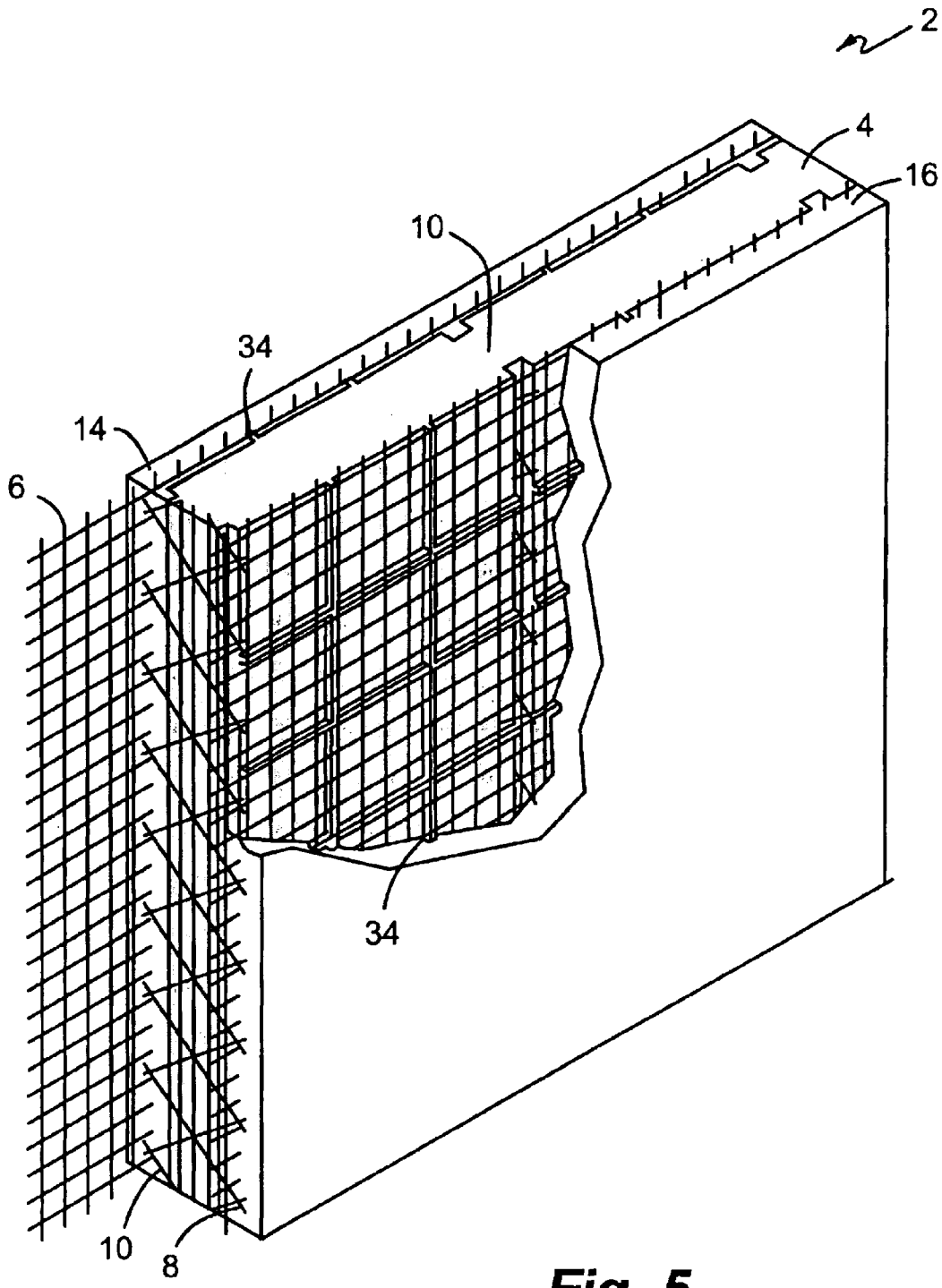
FIG. 5 is a front perspective view of an alternative embodiment of the composite building panel of the present invention, wherein the insulative core has a waffleboard design.

Referring now to FIG. 5, an alternative embodiment of the present invention is provided herein, wherein the insulative core 4 has an exterior surface and an interior surface with a specific geometric profile to provide sufficient spacing between the adjacent carbon fiber grids. More specifically, in this embodiment the insulative core 4 has a "waffleboard" profile which comprises a plurality of vertical and horizontally oriented rails which provide spacing between the surface of the insulative core 4, and the interior carbon fiber grid 6 or exterior carbon fiber grid 8. In a preferred embodiment the protruding rails extend outwardly about ¼ inch, but may vary between ⅛ and 1.5 inches depending on the application. In the embodiment shown in FIG. 5, the extruding rails are positioned on both an exterior surface of the insulative core 4 and in interior surface. As appreciated by one skilled in the art, depending on the application the spacing means may be provided on an exterior surface, an interior surface or both.

Figure 6:
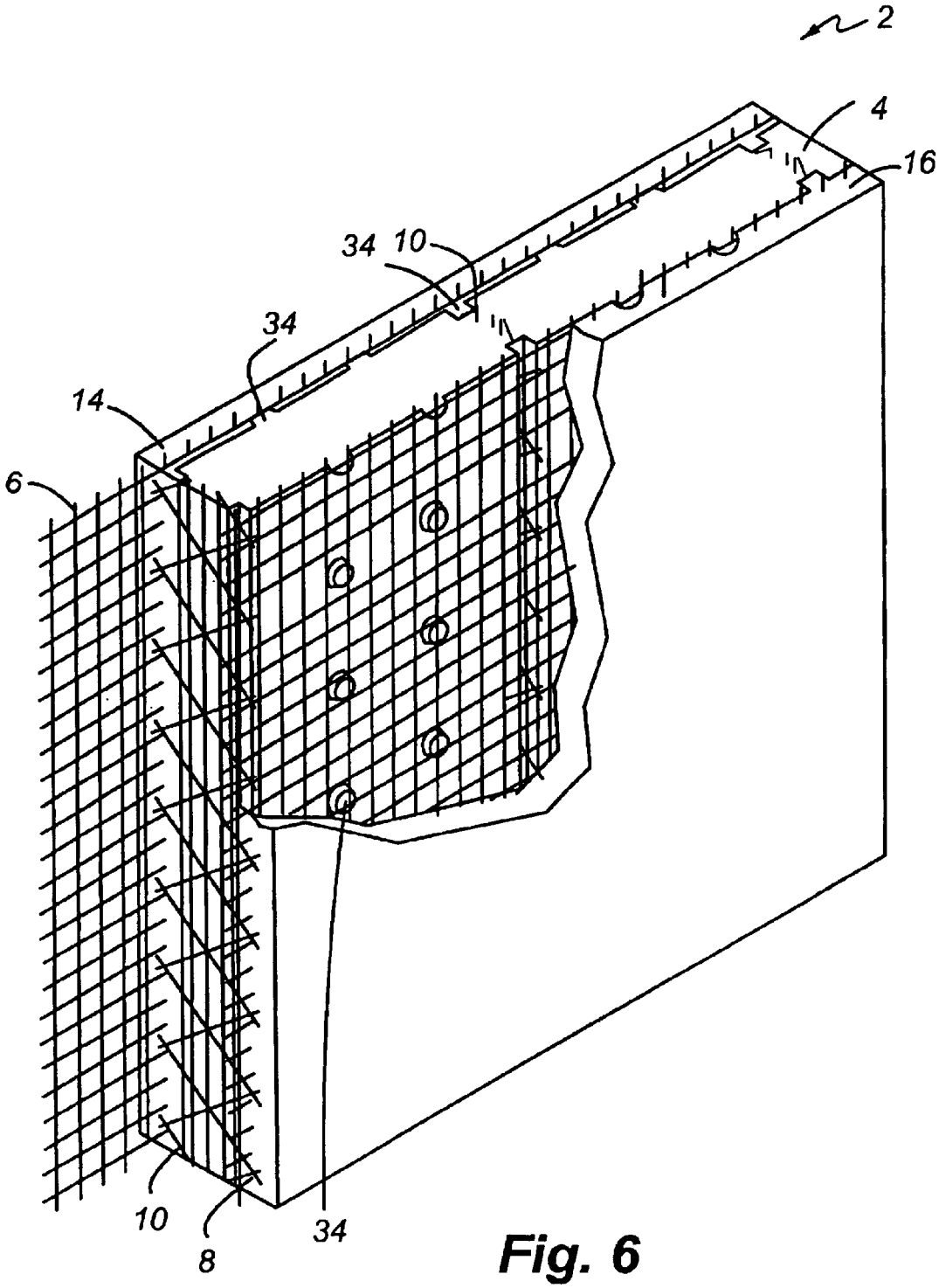
FIG. 6 is a front perspective view of an alternative embodiment of the composite building panel of the present invention, where the insulative core comprises a plurality of spacing members.

Referring now FIG. 6, an alternative embodiment of the present invention is provided herein, wherein spacing between the insulative core 4 and carbon fiber grids are provided with a plurality of "buttons" 34 or other types of protuberances which selectively raise the interior and exterior carbon fiber grids a preferred distance with respect to the interior and exterior surface of the insulative core 4. In this particular embodiment, the spacing buttons 34 are positioned at approximately four inch intervals, in both a horizontal and vertical direction, but as appreciated by one skilled the art may have any variety of spacing configurations between about 2 inches and 2 feet. Furthermore, the spacing buttons 34, rails or protuberances provided in FIG. 6 are preferably integrally molded with the insulative core 4 during manufacturing, although this type of spacing apparatus 34 may be selectively interconnected after manufacturing by means of adhesives, nails, screws, or other apparatus commonly known in the art.

Figure 7:
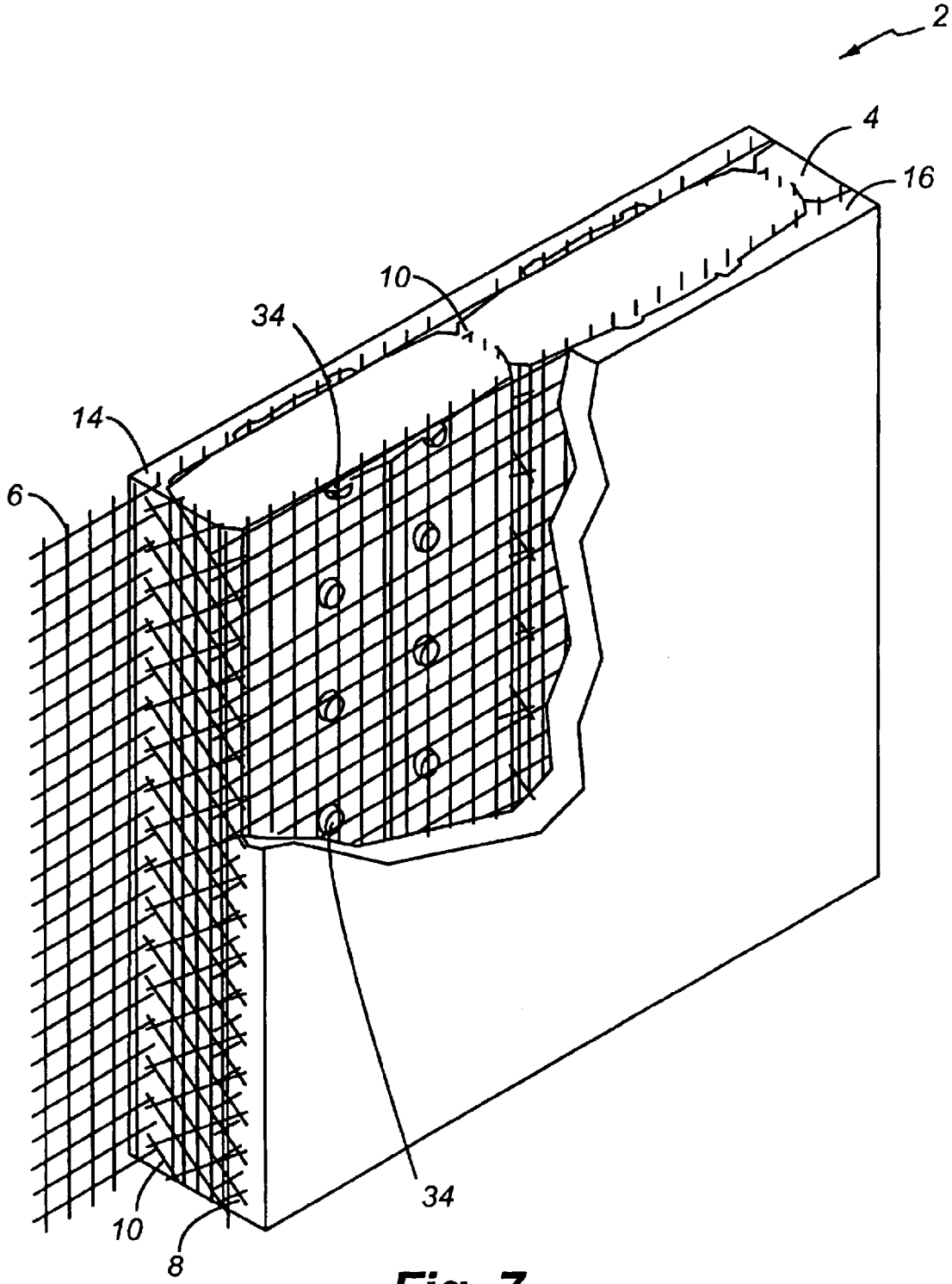
FIG. 7 is a front perspective view of an alternative embodiment of the invention shown in FIG. 6, wherein the insulative core has a tapered geometric profile.

Referring now to FIG. 7, an alternative embodiment of the invention shown in FIG. 6 is provided herein. More specifically, the insulative core 4 of FIG. 7 has a tapered geometric profile as viewed from a top plan view, wherein the transversely oriented carbon fiber strands 10 penetrate through the insulative core 4 at a location with a reduced thickness. This tapered profile repeats itself in between each of the transversely oriented carbon fiber ribbon/tape strands 10 to provide a somewhat arcuate or tapered shape. Preferably, the distance between the widest and narrowest portion of the insulative core 4 has a difference in width of between about 0.25 and 1.5 inches, and more preferably about ⅜ of inch.

Figure 8:
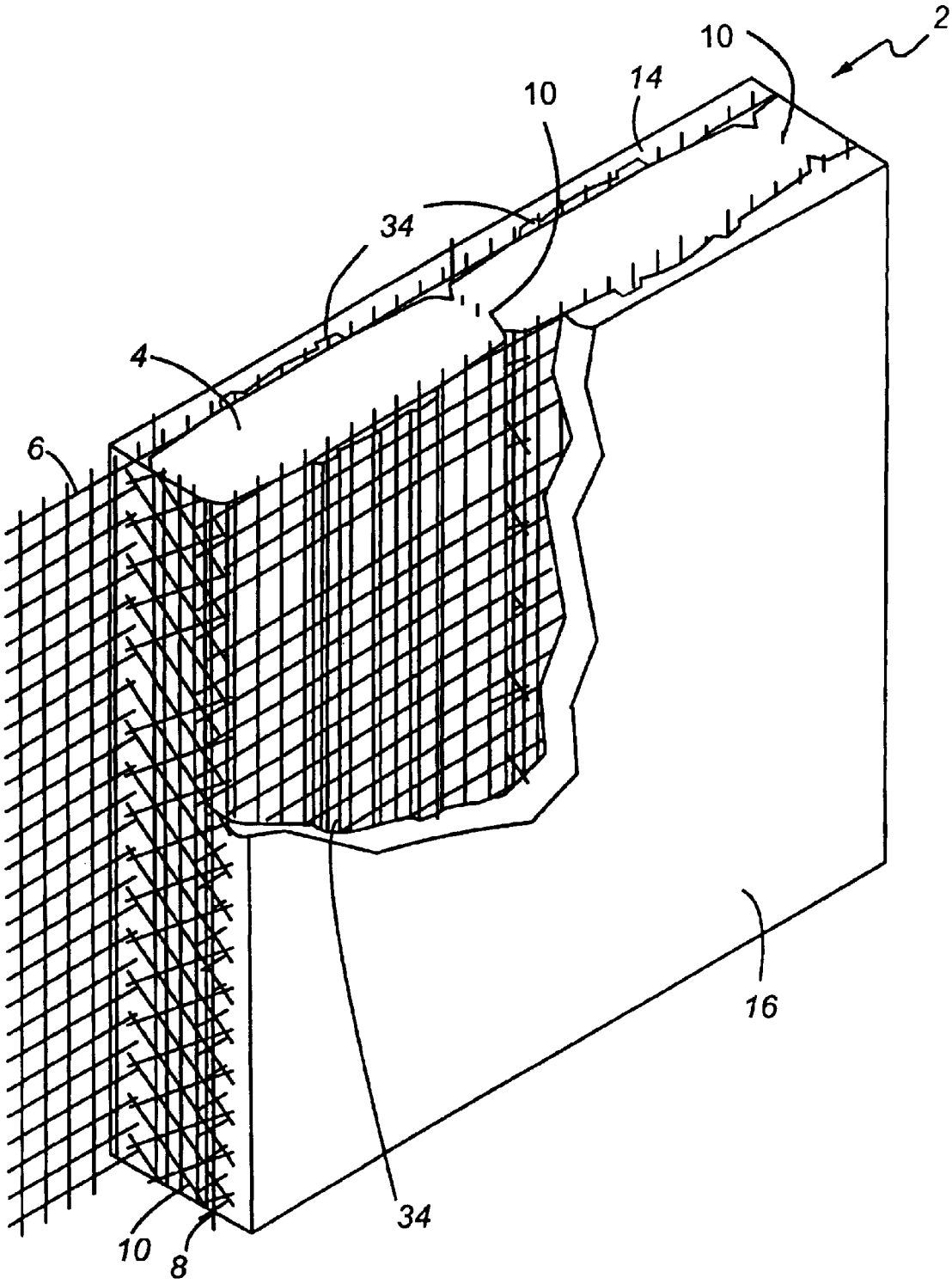
FIG. 8 is a front perspective view of an alternative embodiment of the composite building panel of the present invention wherein the insulative core has vertically oriented protruding strips as spacing members.

Referring now to FIG. 8, an alternative embodiment of the present invention is provided herein, wherein the insulative core 4 has a tapered, arcuate shaped profile, and further includes a plurality of spacing rails 34 oriented in a substantially vertical direction and with a preferred spacing. Thus, the width of the insulative core 4 is greatest at the location of the spacing rails 34, and is at a minimum at the positioning of the transverse oriented carbon fiber strands 10. As appreciated by one skilled in the art, the spacing apparatus may have any possible shape or dimension, as long as space is provided between the front surface or back surface of the insulative core, respectively and the interior and exterior grids to allow room for a cladding material such as concrete.

Figure 9:
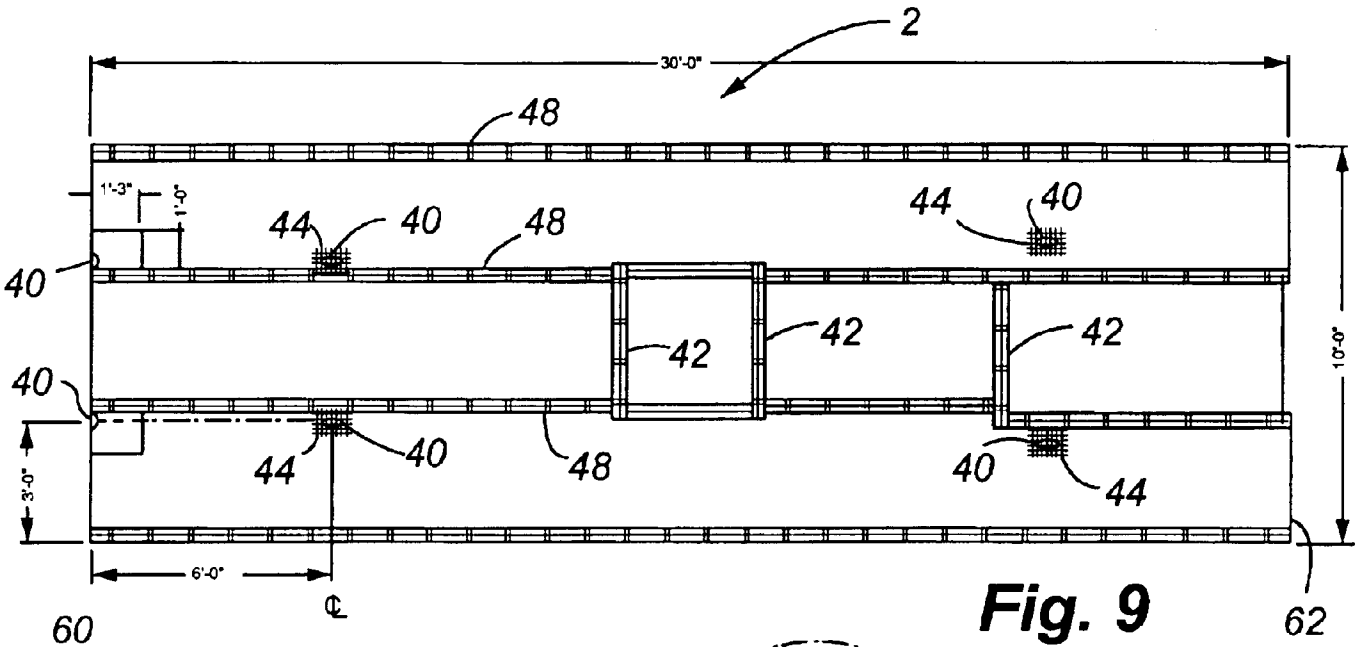
FIG. 9 is a plan view of an alternative embodiment of the present invention which identifies a building panel with a plurality of reinforcing strips positioned therein.
Figure 11:
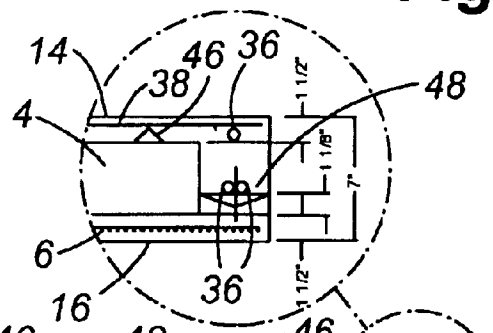
FIG. 11 is an exploded view of the right hand corner of FIG. 10, and depicting the components provided therein.
Figure 10:
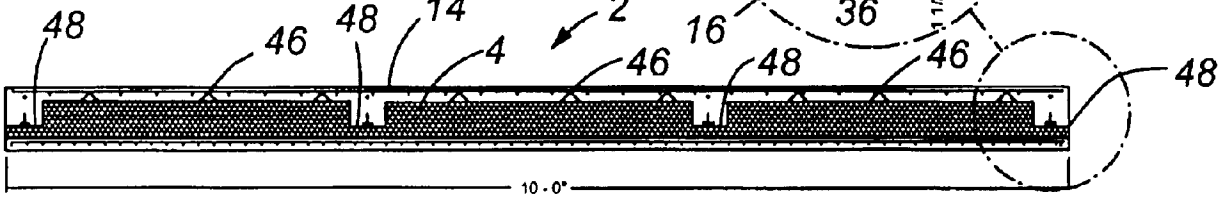
FIG. 10 is a cross sectional elevation view of the embodiment shown in FIG. 9.

Referring now to FIG. 9, an alternative embodiment of a composite building panel 2 of the present invention is depicted. More specifically, the composite building panel 2 comprises a building panel upper end 60, a building panel lower end 62 and a plurality of reinforcing strips 48 which support an insulative core 4 with both an interior concrete layer 14 and an exterior concrete layer 16. A reinforced window/door frame 42 may also be provided which allows for customizing a given building panel 2. As further seen in FIG. 9, a plurality of lifting anchors 40 may be selectively provided on an interior or exterior surface of the concrete, as well as on either a building panel upper end 60 or a building panel lower end 62. The lifting anchors 40 on either the interior or exterior surface are used to remove the composite building panel 2 from the form during manufacturing, while the lifting anchors 40 positioned on the building panel upper end 60 are used during transportation and erection of the building panel. Referring now to FIG. 10, a cross-section of the embodiment shown in FIG. 9 is provided herein. FIG. 10 identifies the insulative core 4 and the interior concrete layer 14 and exterior concrete layer 16. FIG. 11 provides an expanded view of FIG. 10, and shows in significant detail the various components in one embodiment of the present invention. More specifically, an exterior concrete layer 16 is provided which includes an interior carbon fiber grid 6 which extends substantially from the building panel upper end to the building panel lower end 62. An interior portion of the building panel 2 is comprised of an insulative core 4 which is positioned between the exterior concrete layer 16 and the interior concrete layer 14. Positioned between the interior concrete surface and the insulative core 4 in one embodiment is a wire mesh material 38 which extends substantially from the building panel upper end 60 to the building panel lower end 62. Alternatively, a carbon fiber material, fiberglass, plastic or other material commonly known in the art could be used to enhance strength and durability. In a preferred embodiment, the wire mesh 38 is positioned above the insulative core 4 by a plurality of wire mesh/foam spacers 46 to assure that a substantially constant thickness of concrete is provided between the insulative core 4 and the building panel interior surface 14.

As additionally identified in FIG. 11, a "cutout portion" of the insulative core 4 is provided and which is referred to herein as a reinforcing strip 48. The reinforcing strip 48 may be installed independently during manufacturing and positioned between a plurality of insulative core panels 4, or may be integrally molded into the insulative core 4 during manufacturing of the insulative core 4. More specifically, the reinforcing strip 48 is generally comprised of a carbon fiber sheer strip 30 which extends through the reinforcing strip 48 and runs in a substantially linear direction from the building panel upper end 60 to the building panel lower end 62. Alternatively, fiberglass, wire mesh, or other materials commonly known in the art could be used to increase tensile and compressive strength and based on the specific design criteria.

Positioned proximate to the carbon fiber sheer strip 30 is one or more reinforcing bar 36, which are generally "rebar" materials manufactured from carbon steel or other similar metallic materials. Preferably, the reinforcing bar 36 has a diameter of at least about 0.5 inches, and more preferably about 0.75–1.00 inches. As appreciated by one skilled in the art, the reinforcing bars 36 may be any variety of dimensions or lengths depending on the length and width of the building panel 2, and the strength requirements necessary for any given project. As additionally seen in FIG. 11, a third reinforcing bar 36 may additionally be positioned proximate to the wire mesh 38 adjacent the building panel interior surface 14 to provide additional strength and durability.

Figure 12:
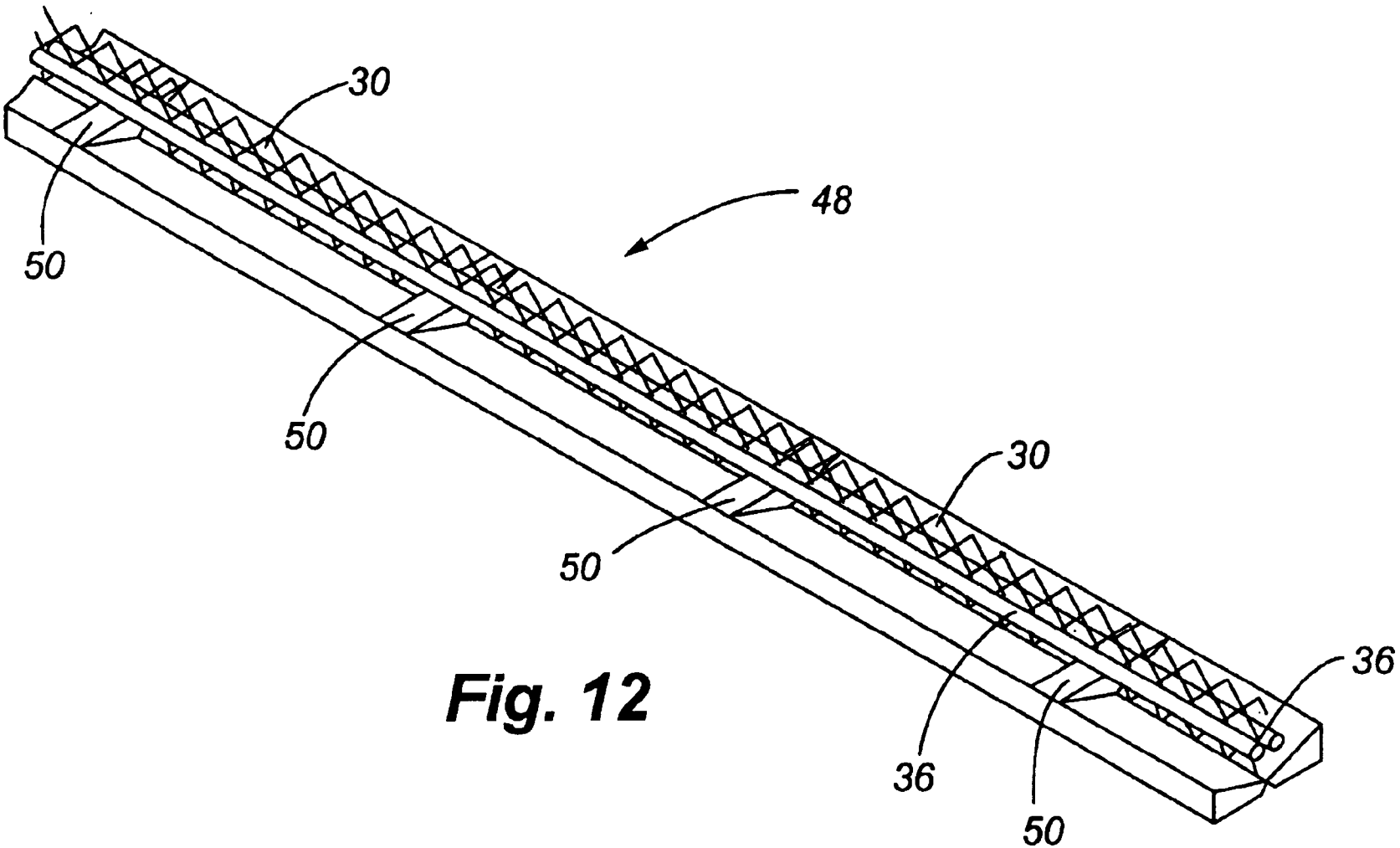
FIG. 12 is a front perspective view of one embodiment of a reinforcing strip of the present invention.

Referring now to FIG. 12, a front perspective view is provided of the reinforcing strip 48 depicted in FIGS. 9–11. More specifically, in one embodiment of the present invention, individual reinforcing strips 48 are used during manufacturing and placed between a plurality of insulative core panels 4. The reinforcing strips 48 are installed to provide additional tensile and compressive strength for the composite building panel 2.

As shown in FIG. 12, the reinforcing strip 48 is generally comprised of a one piece foam material comprised of an expanded polystyrene type material, and which includes a plurality of support braces 50. The support braces support one or more reinforcing bars 36 which extend substantially along the longitudinal length of the reinforcing strip 48. Additionally, a reinforcing material such as a carbon fiber sheer strip 30 is provided which extends through the reinforcing strip 48 in a substantially perpendicular orientation with respect to the longitudinal orientation of the reinforcing strip 48, and is designed to be in contact with both the interior concrete layer 14 and exterior concrete layer 16. Although in this particular example the sheer strip 30 is comprised of a carbon fiber material, other material such as fiberglass, plastic, or a metal mesh material may additionally be used to provide additional reinforcement between the rebar, the insulative core 4, and the concrete materials used in the fabrication of the building panel 2.

Figure 13:
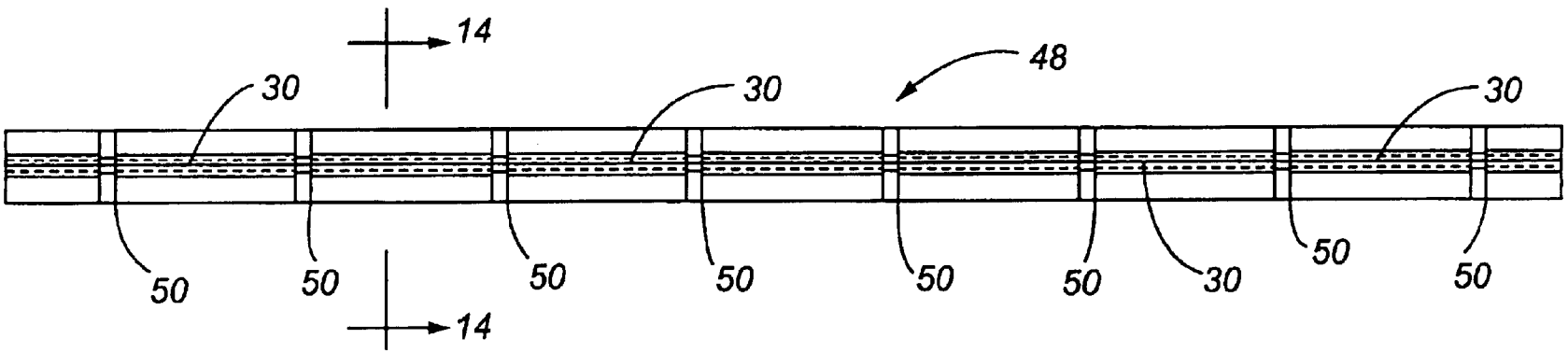
FIG. 13 is a top plan view of the reinforcing strip shown in FIG. 12.

Referring now to FIG. 13, a top plan view of the reinforcing strip 48 shown in FIG. 12 is provided herein. More specifically, FIG. 13 depicts a plurality of support braces 50, as well as the carbon fiber sheer strip 30 extending substantially through the interior of the reinforcing strip 48 and extending substantially along the entire length of the reinforcing strip 48. In this particular drawing, the reinforcing bars 36 are not shown for clarity, but as identified in FIG. 12 are generally supported by the plurality of support braces 50 positioned at predetermined intervals along the length of the reinforcing strip 48.

Figure 14:
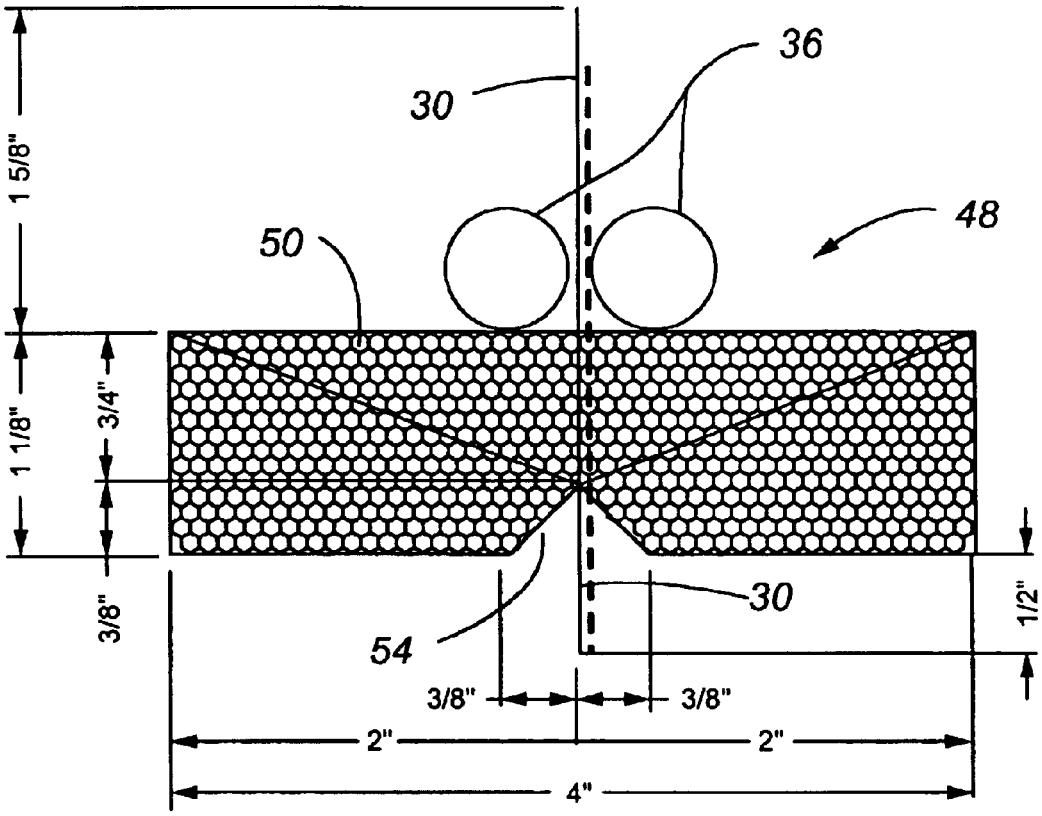
FIG. 14 is a cross sectional elevation view taken at line AA of the reinforcing strip shown in FIG. 13.

Referring now to FIG. 14, a cross sectional, front elevation view taken along line AA at FIG. 13 is provided herein, and which depicts the reinforcing strip 48 in greater detail.

More specifically, the insulative core 4 is comprised in one embodiment of a substantially "v"-shaped member which has a plurality of support braces 50 positioned at predetermined intervals to support one or more reinforcing bars 36. As stated before, the reinforcing bars 36 are typical steel rebar materials commonly known by those skilled in the art, and which could have any varying number of dimensions based on the strength requirements of the composite insulative panel 2. As additionally shown in FIG. 14, the carbon fiber sheer strip 30 is shown penetrating the insulative core material 4, as well as the plurality of support braces 50. Thus, the carbon fiber sheer strip 30 extends through the reinforcing strip 48 and is embedded in both the interior concrete layer 14 and exterior concrete layer 16 upon completion of the manufacturing process.

Figure 15C:
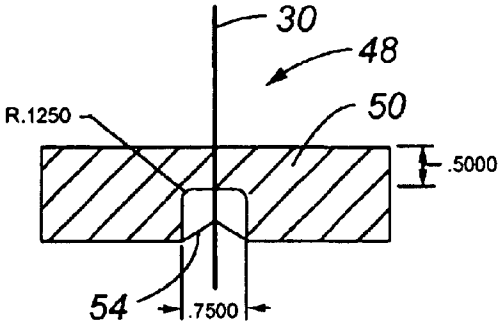
FIG. 15C is a cross sectional elevation view taken at line CC of the embodiment shown in FIG. 15.
Figure 15B:
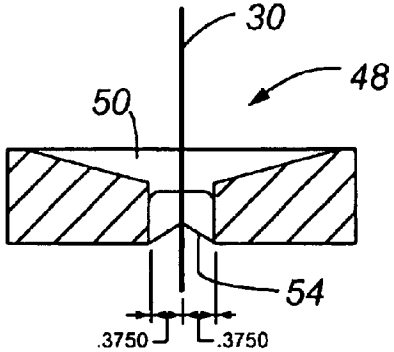
FIG. 15B is a cross sectional elevation view taken at line BB of the embodiment shown in FIG. 15.
Figure 15A:
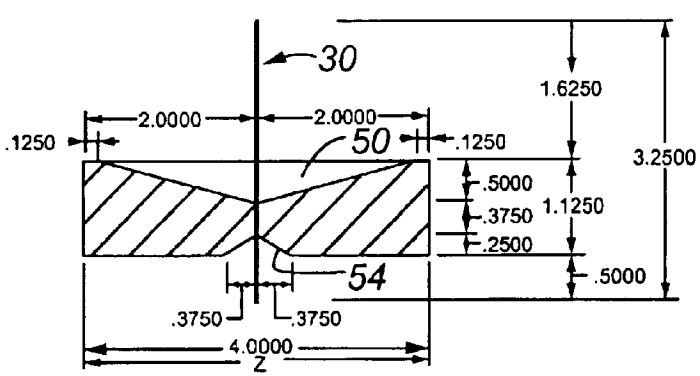
FIG. 15A is a cross sectional elevation view taken at line AA in FIG. 15.
Figure 15:
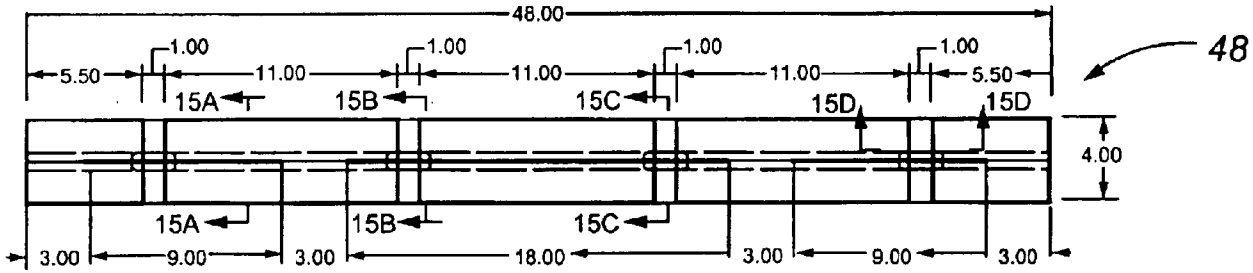
FIG. 15 is a plan view of one embodiment of a reinforcing strip of the present invention.
Figure 15D:
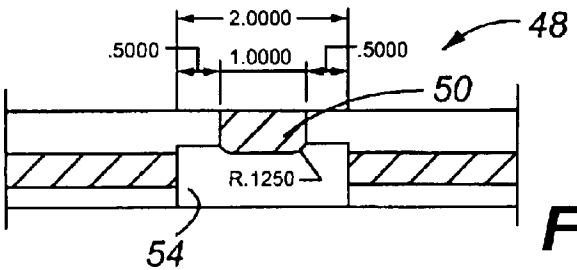
FIG. 15D is a cross sectional view taken at line DD of the invention shown in FIG. 15.

Referring now to FIGS. 15–15D, additional detail is provided with regard to the reinforcing strip 48 and more specifically identifying the construction therein. As shown in FIG. 15, a plan view of the reinforcing strip 48 is provided, with detailed sectional views taken at line "AA" shown in FIG. 15A, section "BB" shown in FIG. 15B, section "CC" shown in FIG. 15C, and section "DD", as shown in FIG. 15D. More specifically, FIGS. 15A and 15B identify the positioning of the support brace 50 as well as a reinforcing strip "cut out" 54 which is positioned below the braces and which allow for the penetration of concrete around and below the reinforcing strip 48 member. Thus, the concrete during fabrication is positioned both above the reinforcing strip 48, below the reinforcing strip 48, and substantially around the carbon fiber sheer strip 30 and below the support braces 50. This design assures that there are substantially no voids or air bubbles in the concrete, thus improving the strength and durability of the composite building panel 2.

Figure 16:
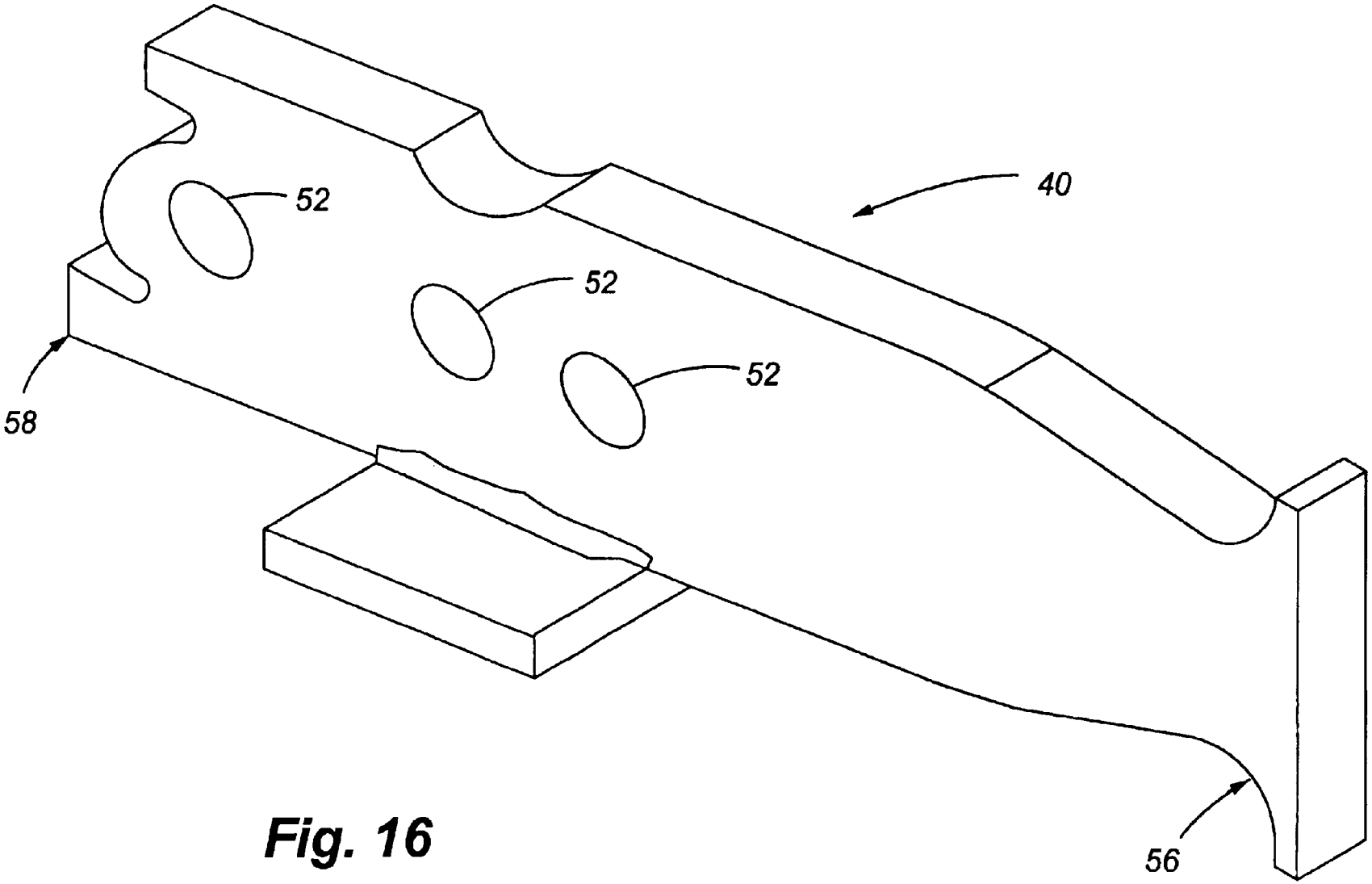
FIG. 16 is a front perspective view of one type of lifting anchor which is interconnected to the insulative building panel of the present invention.

Referring now to FIG. 16, a front perspective view of a lifting anchor 40 is provided herein, and which is generally comprised of an interior end 56, an exterior end 58, and including a plurality of apertures 52 positioned therebetween. More specifically, the lifting anchor is generally positioned on the building panel upper end 60, as shown in FIG. 9, but alternatively may be put on the building panel lower end 62. During manufacturing the lifting anchor 40 is positioned in a cut out portion of the insulative core 4 and in a preferred embodiment a reinforcing bar 36 is extended through one or more of the lifting anchor apertures 52 and embedded in concrete during manufacturing. Further, the lifting anchor exterior end 58 may include a plastic insert on the exterior end 58, which is positioned during manufacturing to substantially prevent concrete from filling the void portion which is used for lifting during construction. The lifting anchor interior end 56 is merely positioned more towards an interior portion of the building panel 2 and is used to provide support for lifting. As appreciated by one skilled in the art, the lifting anchor 40 is generally comprised of a metallic material such as carbon steel, but could alternatively be constructed of other durable materials which have an extremely high tensile strength.

Figure 17:
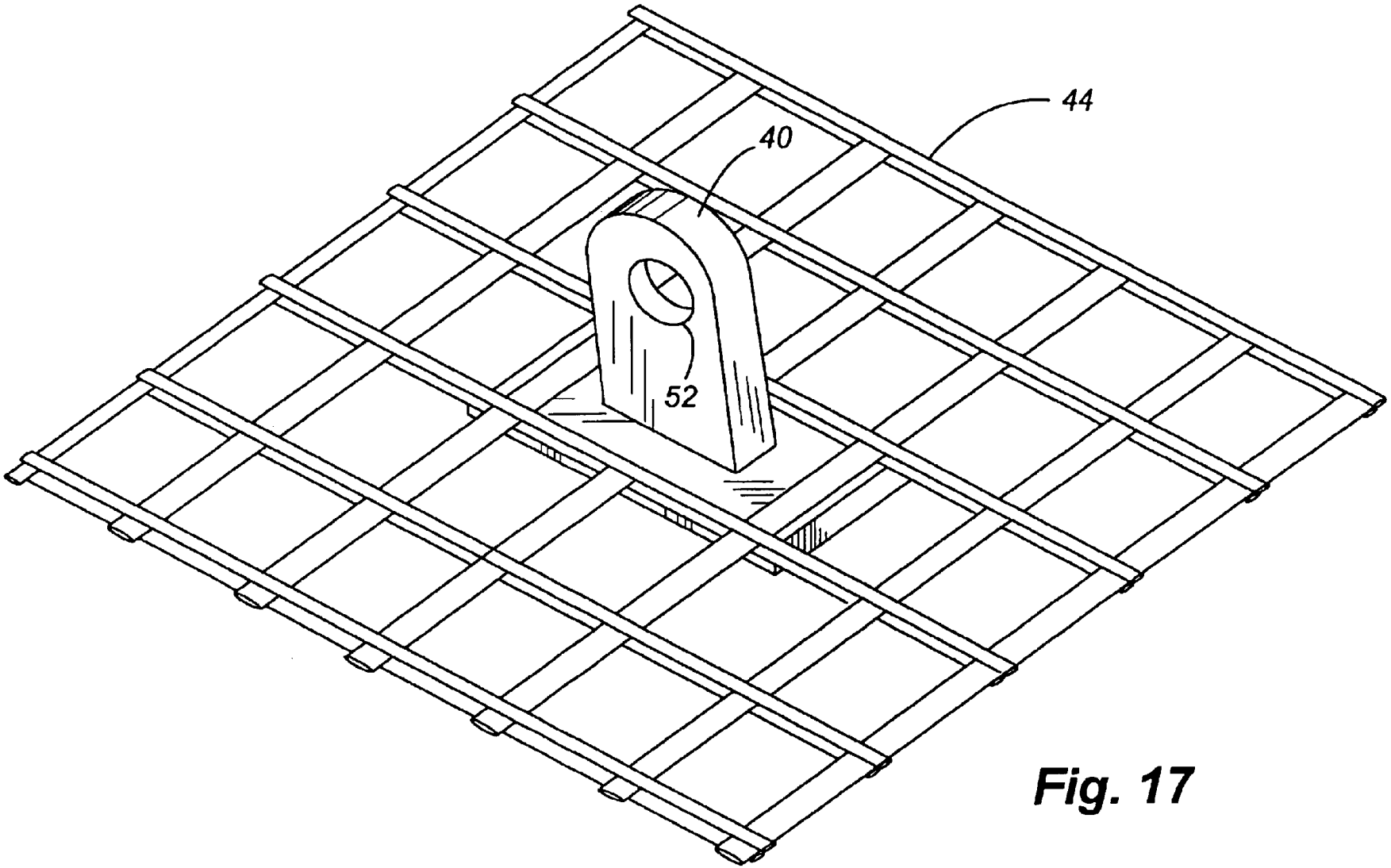
FIG. 17 is one embodiment of a lifting anchor and associated carbon fiber mesh material which may be interconnected to an interior or exterior surface of the insulative building panel of the present invention.

Referring now to FIG. 17, an alternative embodiment of a lifting anchor 40 is provided herein, and which is surrounded with a lifting anchor reinforcing mesh material 44 such as carbon fiber. Alternatively, the mesh material could be steel, fiberglass, or other reinforcing materials commonly known in the art. The lifting anchor 40 shown in FIG. 17 is generally positioned on an interior or exterior concrete layer during manufacturing, and is positioned at a predetermined location at one or more locations once the interior concrete layer 14 has been poured. Preferably, the lifting anchor 40 and associated lifting anchor reinforcing mesh material 44 are positioned at least about ½ to 1 inch deep in the interior concrete layer, and are used to lift the composite building panel 2 from the form during manufacturing and after the concrete has cured. Alternatively, nylon rope or other materials may be used as lifting anchors 40, and which can be quickly removed by using a knife or other sharp cutting instrument after the building panel 2 is removed from the fabrication form 68, or installed at the building site.

Figure 18:
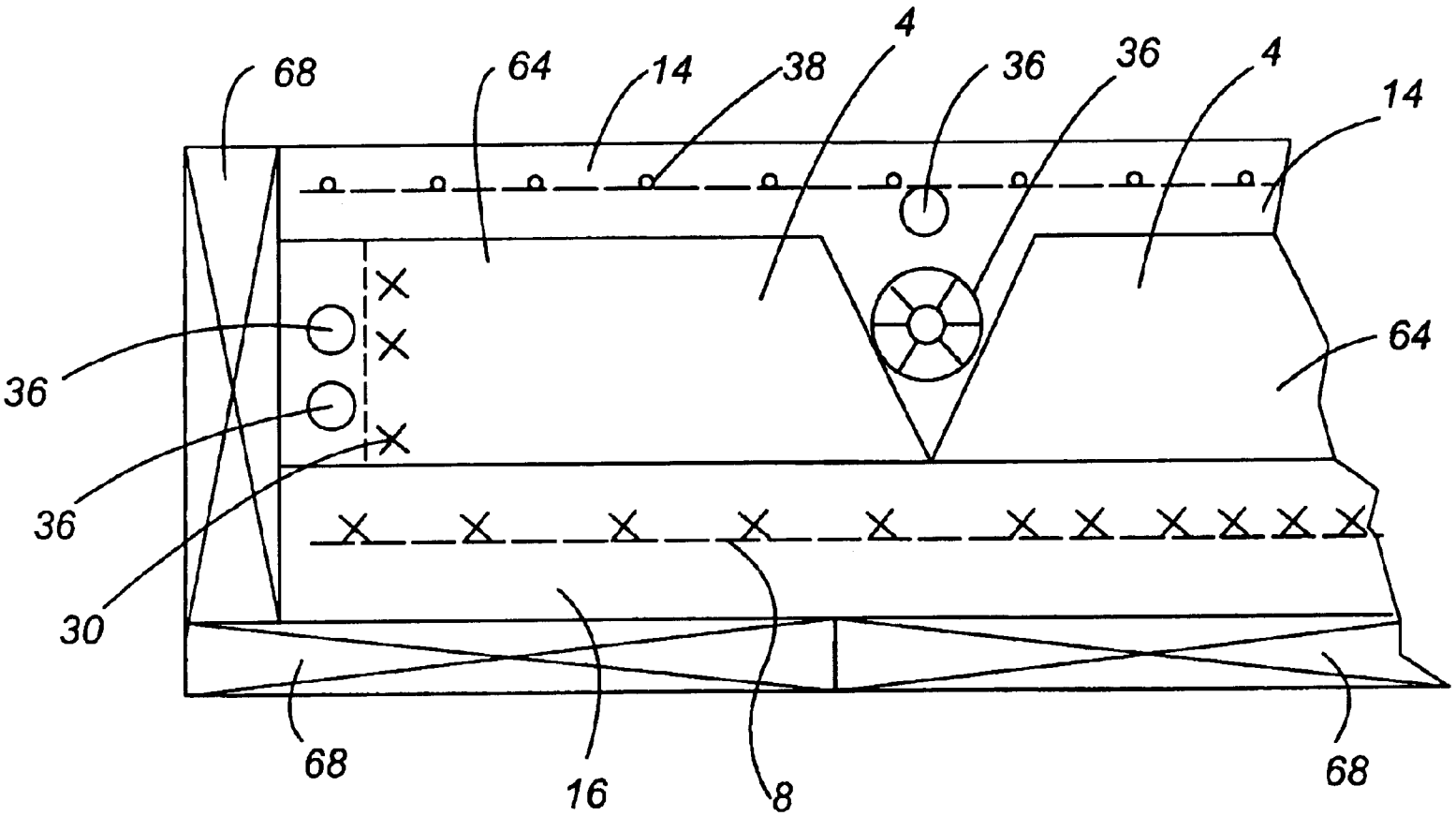
FIG. 18 is a cross-sectional, front elevation view of an alternative embodiment of the present invention.

Referring now to FIG. 18, an alternative embodiment of the present invention is provided herein. More specifically, the embodiment of FIG. 18 shows a cross-sectional elevation view of a composite building panel 2, and generally depicting an insulative core 4 which is sandwiched between an interior concrete layer 14 and an exterior concrete layer 16. The building panel 2 is fabricated by utilizing a fabrication form 68 which has a predetermined size and shape, and which supports the concrete and other building materials during fabrication. These forms are typically made of steel or other metallic materials, but may be made from wood, fiberglass or other materials well known in the art.

Preferably, the exterior concrete layer 16 includes an exterior carbon fiber grid 8 which is sandwiched between two layers of concrete. Further, the interior concrete layer 14 has a wire mesh material 38 positioned therein, and which may additionally be interconnected to a reinforcing bar 36. Furthermore, a perimeter edge of the composite building panel 2 may include one or more reinforcing bars 36, as well as a carbon fiber ribbon/tape sheer strip 30. In an alternative embodiment not shown in the drawings, the entire interior concrete layer 14 may be omitted, along with carbon fiber or wire mesh material. This provides additional reductions in weight and expense. In this embodiment, drywall or other clodding materials may be installed after erection of the building panel 2.

Figure 19:
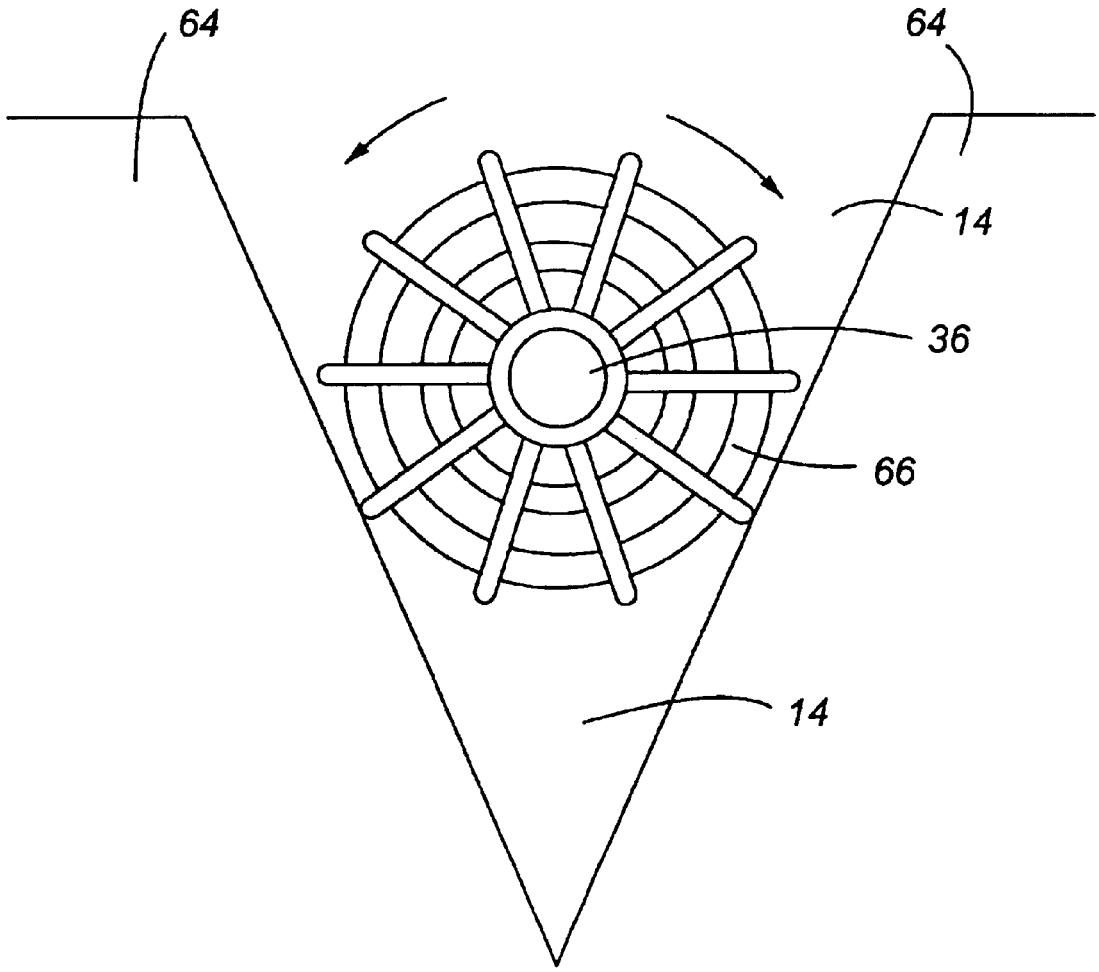
FIG. 19 is an exploded view of one portion of the invention shown in FIG. 18, and more specifically identifying a rebar-spacer positioned between two individual panels of insulative core materials.

As further depicted in FIG. 18 and FIG. 19, the composite building panel 2 of the present invention may be comprised of a plurality of individual insulative core panels 64, which have at least one beveled edge which adjoin to create a substantial "v" or "y" shape. This geometric configuration is adapted for supporting one or more reinforcing bars 36, in combination with a carbon fiber sheer strip 30 or a wire mesh material 38. More specifically, and referring now to FIG. 19, a cross-sectional front elevation view is shown which depicts a reinforcing bar 36 interconnected in a preferred embodiment to a rebar spacing ring 66. The spacing ring 66 is designed to support the reinforcing bar 36 at a predetermined distance from the insulative core panels 64, and which allows for the penetration of concrete behind the reinforcing bar 36. Generally, the rebar spacing ring 66 is comprised of a pliable plastic material which may be pulled apart to receive the reinforcing bar 36, and is applied as necessary during fabrication of the building panel 2 at predetermined intervals.

Figure 20:
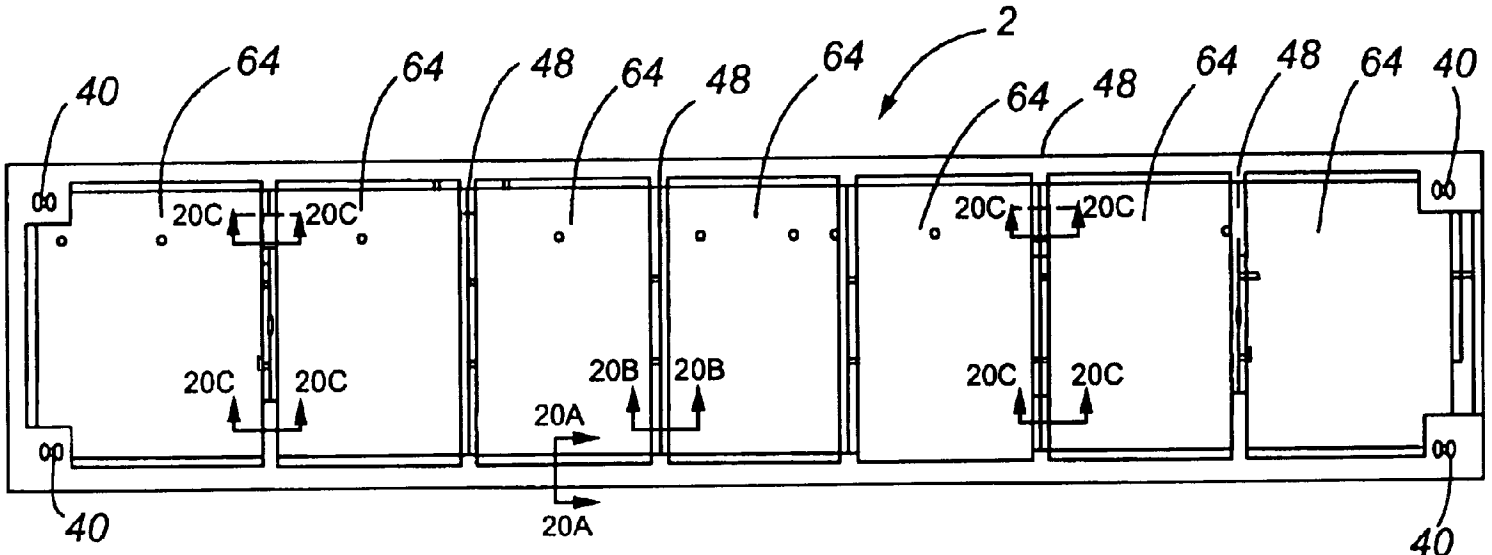
FIG. 20 is a plan view of an alternative embodiment of the present invention and depicting additional detail.
Figure 21:
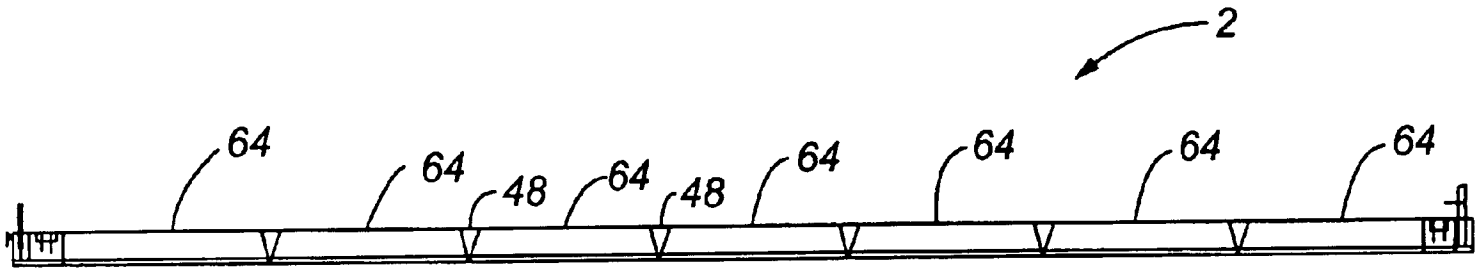
FIG. 21 is a cross-sectional front elevation view of the embodiment depicted in FIG. 20.
Figure 20A:
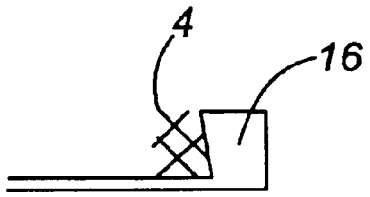
FIG. 20A is a cross-sectional view of FIG. 20 taken at line "AA"
Figure 20B:
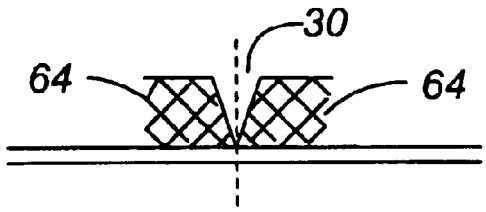
FIG. 20B is a cross-sectional elevation view of the invention shown in FIG. 20 shown at line "BB"
Figure 20C:
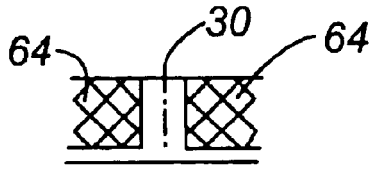
FIG. 20C is a cross-sectional elevation view taken at line "CC" of the invention shown in FIG. 20.
Figure 22:
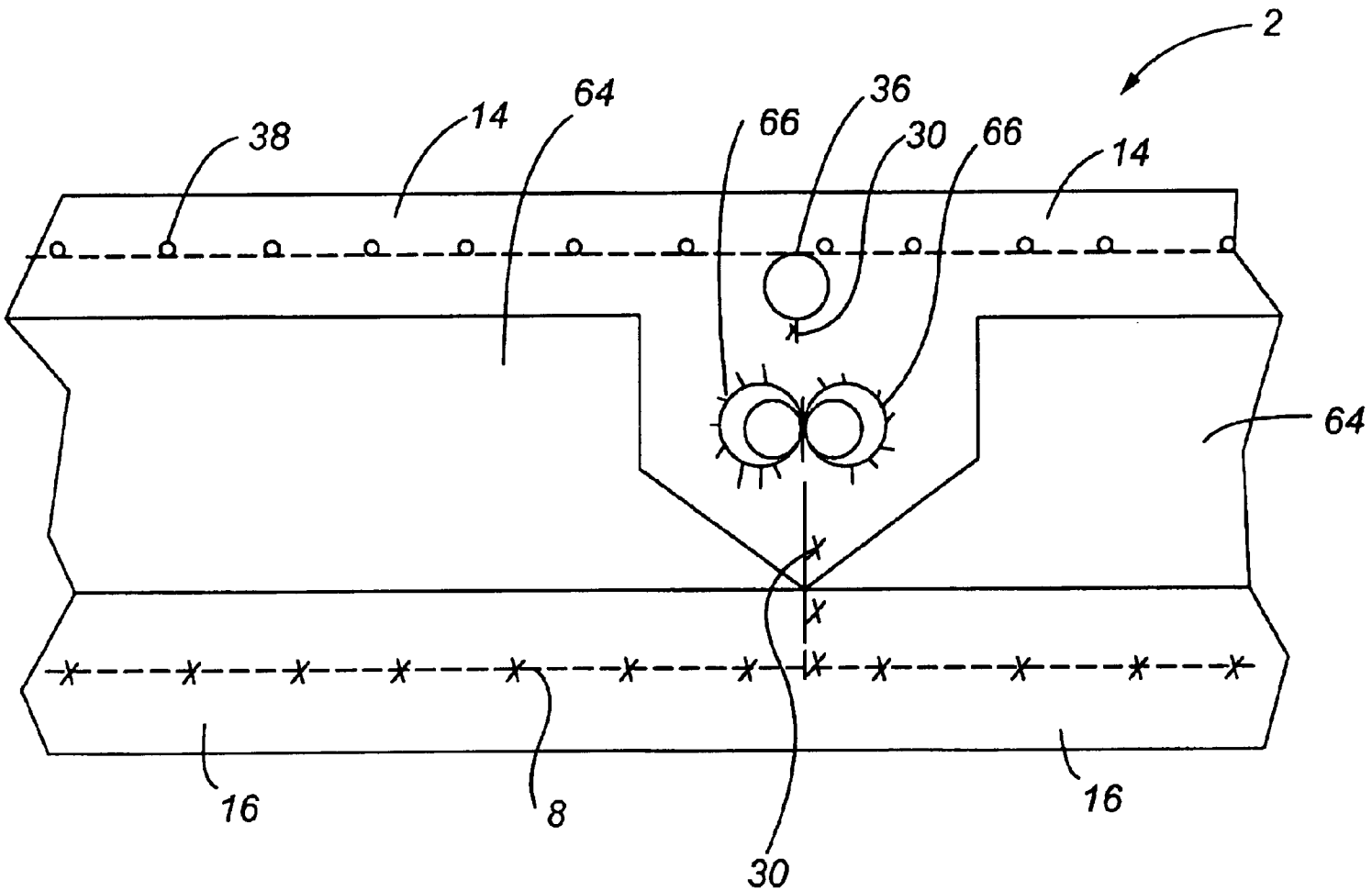
FIG. 22 is a cross-sectional front elevation view of an alternative embodiment of the present invention.

Referring now to FIGS. 20–21, an alternative embodiment of the present invention is provided herein. More specifically, FIG. 20 represents a top plan view, while FIGS. 20A, 20B, and 20C represent cross sectional elevation views taken at the respective lines designated in FIG. 20, i.e. line "AA", line "BB", and line "CC". FIG. 21 represents a front elevation view of the embodiment shown in FIG. 20, and depicts various features of this particular embodiment. More specifically, the insulative composite building panel 2 shown in FIGS. 20–21 includes a plurality of insulative core panels 64 which are positioned in an abutting relationship with a beveled edge. The beveled edges of the insulative core panels 4 create a "v" or "y" shape, which is adapted to receive one or more metallic reinforcing bars 36, and preferably a carbon fiber sheer strip 30. Alternatively, other materials such as fiberglass, plastic, or wire mesh materials may be used as opposed to the carbon fiber. A further detailed embodiment of this particular invention is shown in FIGS. 18–19. Alternatively, and as depicted in FIG. 22, two or more reinforcing bars may be positioned within the "y" shaped cut-out formed by the abutment of the individual core panels 64. Further, a third reinforcing bar 36 is preferably positioned immediately above the reinforcing bars 36 positioned in the "y" cut-out, and more preferably is interconnected to the sheet of wire mesh material 38.

In another aspect of the present invention, a method of manufacturing the composite building panel 2 of the present invention is provided herein. More specifically, the manufacturing process is generally initiated by providing a form having a first and a second end and lateral edges extending therebetween, the form providing a shell for receiving the concrete materials and other components. Initially, a first layer of concrete material is poured into a lower portion of the form. Once a substantially uniform thickness is obtained, a first grid of reinforcing materials is positioned into the concrete material. Preferably, the first grid of reinforcing materials comprises a carbon fiber grid. Once the carbon fiber grid is positioned within the first layer of concrete material, a layer of insulative core 4 is provided onto the concrete material. In a preferred embodiment of the present invention, the insulative core 4 is comprised of a plurality of individual insulative core panels 4 which have been cut to the preferred dimensions of the composite building panel form. Further, at predetermined widths and on the exterior edges of the composite building panel, a reinforcing strip 48 is provided which includes a second grid of reinforcing materials such as carbon fiber, and which extends substantially between the first and second end of said insulative core 4.

The reinforcing strip 48 may include one or more reinforcing bars 36 which extend substantially from the first end to the second end of the insulative core 4, and which is positioned proximate to the carbon fiber reinforcing grid 30. Once the insulative core 4 and associated reinforcing strip 48 are positioned on top of the first layer of concrete, a second layer of concrete is poured on top of the layer of insulative core 4. Additionally, further reinforcing bars may be positioned proximate to the reinforcing strip 48 and in the same longitudinal direction to provide additional strength. Once the second layer of concrete has been poured, a reinforcing grid is positioned within the concrete which is preferably comprised of a metallic mesh material 38, or alternatively carbon fiber, fiberglass or plastic materials. In a preferred embodiment of the present invention, prior to pouring the second layer of concrete over the insulative core 4, a plurality of spacers 46 are provided on top of the insulative core 4 to support the wire mesh grid 38, and to provide a substantially uniform thickness of concrete 14 between the insulative core 4 and the wire mesh grid 38.

Once the second layer of concrete has been poured and a uniform thickness achieved, one or more lifting anchors 40 and associated lifting anchor reinforcing mesh materials 44 may be positioned within the second layer of concrete. As previously stated, these particular lifting anchors 40 are used to remove the concrete panel from the form after the concrete is allowed to cure. Furthermore, lifting anchors 40 as shown in FIG. 16 may be provided on the building panel upper end 60 or building panel lower end 62 prior to the pouring of the second layer of concrete. These lifting anchors are used during transportation and erection of the building panel 2.

To assist in the understanding of the present invention, the following is a list of the components identified in the drawings and the numbering associated therewith:

| # | Component |
|---|---|
| 2 | Composite building panel |
| 4 | Insulative core |
| 6 | Interior carbon fiber grid |
| 8 | Exterior carbon fiber grid |
| 10 | Carbon fiber strands |
| 12 | Vapor barrier |
| 14 | Interior concrete layer |
| 16 | Exterior concrete layer |
| 18 | Compression pins |
| 20 | Utility conduit |
| 22 | Exterior cladding |
| 24 | Bricks |
| 26 | Paraffin Coating |
| 28 | Spacers |
| 30 | Carbon fiber ribbon/tape shear strip |
| 32 | Connector clip |
| 34 | Spacing buttons or rails |
| 36 | Reinforcing bar |
| 38 | Wire mesh |
| 40 | Lifting anchor |
| 42 | Reinforced window/door frame |
| 44 | Lifting anchor reinforcing mesh material |
| 46 | Wire mesh/foam spacer |
| 48 | Reinforcing strip |
| 50 | Support brace |
| 52 | Lifting anchor aperture |
| 54 | Reinforcing strip cut-outs |
| 56 | Lifting anchor interior end |
| 58 | Lifting anchor exterior end |
| 60 | Building panel upper end |
| 62 | Building panel lower end |
| 64 | Insulating core panel |
| 66 | Rebar spacing ring |
| 68 | Fabrication form |

The foregoing description of the present invention has been presented for purposes of illustration and description. Furthermore, the description is not intended to limit the invention to the form disclosed herein. Consequently, variations and modifications commenced here with the above teachings and the skill or knowledge of the relevant art are within the scope in the present invention. The embodiments described herein above are further extended to explain best modes known for practicing the invention and to enable others skilled in the art to utilize the invention in such, or other, embodiments or various modifications required by the particular applications or uses of present invention. It is intended that the dependent claims be construed to include all possible embodiments to the extent permitted by the prior art.

What is claimed is:

1. A carbon fiber reinforced concrete building panel, comprising:

a substantially planar concrete panel comprising an inner surface, an outer surface, an upper end and a lower end, and a substantially longitudinal axis defined between said upper end and said lower end;

a first carbon fiber grid positioned within said substantially planar concrete panel between said upper end and said lower end and positioned proximate to said inner surface;

a foam core having an inner surface and an outer surface positioned within said substantially planar concrete panel and extending substantially between said upper end and said lower ends of said substantially planar concrete panel;

at least one carbon fiber shear strip extending through said foam and oriented in a substantially linear direction between said upper end and said lower ends of said substantially planar concrete panel;

at least one first reinforcing bar positioned proximate to said at least one carbon fiber shear strip, and extending substantially between said upper end and said lower end of said substantially planar concrete panel; and a wire mesh material positioned above said upper surface of said foam core and proximate to said outer surface of said substantially planar concrete panel.

2. The carbon fiber reinforced concrete building panel of claim 1, wherein said at least one carbon fiber shear strip is comprised of an interwoven grid of individual carbon fibers.

3. The carbon fiber reinforced concrete building panel of claim 1, further comprising at least one lifting anchor interconnected to at least one of said upper end, said lower end, said outer surface and said inner surface.

4. The carbon fiber reinforced concrete building panel of claim 1, wherein said foam core is comprised of a plurality of individual foam core panels.

5. The carbon fiber reinforced concrete building panel of claim 1, further comprising a second reinforcing bar positioned above said at least one first reinforcing bar and positioned proximate to said wire mesh.

6. The carbon fiber reinforced concrete building panel of claim 1, wherein said at least one carbon fiber shear strips are prefabricated into individual sections of foam panels which have a thickness less than said foam core.

7. The carbon fiber reinforced concrete building panel of claim 1, further comprising a spacer positioned between said foam core and said wire mesh material, wherein a layer of concrete is provided between an outer surface of said foam core and said wire mesh material.

8. The carbon fiber reinforced concrete building panel of claim 1, further comprising a second reinforced section having at least one reinforcing bar oriented in a direction substantially perpendicular to said substantially longitudinal axis to define at least a portion of a window or a door.

9. The carbon fiber reinforced concrete building panel of claim 1, wherein said at least one first reinforcing bar is comprised of a metallic rod having a diameter of at least about 0.50 inches.

10. The carbon fiber reinforced concrete building panel of claim 1, further comprising a third reinforcing bar which is positioned proximate to at least one of a plurality of perimeter edges of said substantially planar concrete panel.

11. The carbon fiber reinforced concrete building panel of claim 1, further comprises a second carbon fiber sheer strip positioned proximate to at least one of a plurality of perimeter edges of said substantially planar concrete panel.

12. The carbon fiber reinforced concrete building panel of claim 1, further comprising at least one spacer positioned at least partially around at least one first reinforcing bar, wherein there is a predetermined amount of separation between said foam core and said at least one first reinforcing bar.

13. A reinforced concrete building panel having an upper end, a lower end, and lateral edges extending therebetween, comprising:

a first layer of concrete having a first reinforcing grid positioned therein;

a second layer of concrete having a second reinforcing grid positioned therein;

a foam core comprised of a plurality of individual panels having at least one beveled edge which defines a groove for receiving at least one reinforcing rod positioned between said first layer of concrete and said second layer of concrete;

a plurality of third reinforcing grids positioned within said foam core and extending between said first layer of concrete and said second layer of concrete, said plurality of third reinforcing grids oriented in a substantially linear direction and extending between said upper end and said lower end of said building panel, wherein said at least one reinforcing rod is positioned proximate to said plurality of third reinforcing grids; and a plurality of spacers interconnected to said at least one reinforcing rod to provide separation between said at least one reinforcing rod and said foam core.

14. The reinforced concrete building panels of claim 13, wherein said first reinforcing grid is comprised of a carbon fiber material.

15. The reinforced concrete building panels of claim 13, wherein said second reinforcing grid is comprised of a wire mesh material.

16. The reinforced concrete building panels of claim 13, wherein said plurality of third reinforcing grids is comprised of a carbon fiber material.

17. The reinforced concrete building panels of claim 13, wherein said third reinforcing grid is comprised of at least one of a plastic material, a metal material and a fiberglass material.

18. The reinforced concrete building panels of claim 13, wherein said second reinforcing grid is comprised of a least one of a plastic material, a metal material and a fiberglass material.

19. The reinforced concrete building panel of claim 13, further comprising a metallic reinforcing rod positioned substantially parallel to said at least one reinforcing rod.

20. The reinforced concrete building panel of claim 13, further comprising a lifting anchor interconnected to at least one of said upper end, said lower end, an interior surface and an exterior surface of said reinforced concrete building panel.

21. The reinforced concrete building panel of claim 13, further comprising a spacer positioned between said foam core and said second reinforcing grid.

22. The reinforced concrete building panel of claim 13, wherein said foam is comprised of an expanded polystyrene material.

23. The reinforced concrete building panel of claim 13, wherein said reinforced concrete building panel has a density of no greater than about 41 pounds per square foot.

24. The reinforced concrete building panel of claim 13, further comprising at least one reinforcing bar positioned along at least one perimeter edge of said reinforced concrete building panel.

* * * * *